US008366387B2

(12) United States Patent
Reuter

(10) Patent No.: US 8,366,387 B2
(45) Date of Patent: Feb. 5, 2013

(54) ENHANCED AXIAL AIR MOVER SYSTEM WITH FLOOR EDGE

(76) Inventor: Grant L. Reuter, Anacortes, WA (US)

( * ) Notice: Subject to any disclaimer, the term of this patent is extended or adjusted under 35 U.S.C. 154(b) by 0 days.

(21) Appl. No.: 12/967,884

(22) Filed: Dec. 14, 2010

(65) Prior Publication Data

US 2011/0081241 A1 Apr. 7, 2011

Related U.S. Application Data

(63) Continuation of application No. 12/417,469, filed on Apr. 2, 2009, now abandoned, which is a continuation of application No. 11/426,911, filed on Jun. 27, 2006, now abandoned.

(51) Int. Cl.
*F04D 3/00* (2006.01)

(52) U.S. Cl. ..... 415/220; 415/222; 417/423.14; 417/423.15

(58) Field of Classification Search ..... 415/121.1, 415/213.1, 220, 221, 222; 416/247 R; 417/423.14, 417/423.15

See application file for complete search history.

(56) References Cited

U.S. PATENT DOCUMENTS

| | | | | |
|---|---|---|---|---|
| 3,261,107 | A | 7/1966 | Ponczek et al. | |
| 4,886,233 | A * | 12/1989 | Bateman et al. | 248/647 |
| 5,435,695 | A | 7/1995 | Chiu et al. | |
| 5,503,526 | A * | 4/1996 | Neils et al. | 416/63 |
| 5,722,885 | A * | 3/1998 | Matthews | 454/167 |
| 2011/0081241 | A1 * | 4/2011 | Reuter | 415/220 |

* cited by examiner

*Primary Examiner* — Igor Kershteyn
*Assistant Examiner* — Christopher R Legendre
(74) *Attorney, Agent, or Firm* — Davis Wright Tremaine LLP; George C. Rondeau, Jr.

(57) ABSTRACT

Implementations of an enhanced axial air mover system address various issues such as drying performance, transportability, storage, use, and assembly. Some implementations include ergonomic positioning of a carrying handle relative to positioning of a fan-assembly to make the system easier to carry. Enclosures with variable diameter profiles increase air flow performance. A floor edge allows for flush positioning of the air mover's outlet to improve flow of air. Various supports and engagement members allow for horizontal and/or vertical engagement of a plurality of the air movers for storage or increased air moving capacity for a given application. An alignment guide assists with positioning of the air mover with respect to a room wall to enhance air flow within the room. A cord retaining system provides an enhanced approach for securing the air mover's electrical cord. Grill guards have slotted ends to assist with assembly of the air mover.

1 Claim, 29 Drawing Sheets

ENHANCED AXIAL AIR MOVER SYSTEM WITH FLOOR EDGE

BACKGROUND OF THE INVENTION

1. Field of the Invention

The present invention is related to axial air movers.

2. Description of the Related Art

Air movers are used for such applications as to dry buildings and other structures when accidents have occurred causing areas in the buildings and other structures to become wet. Unfortunately, conventional air movers can be noisy, can waste energy, and can raise difficulties in transport, use, storage, and assembly of the units.

BRIEF DESCRIPTION OF THE SEVERAL VIEWS OF THE DRAWING(S)

DETAILED DESCRIPTION OF THE INVENTION

As discussed herein, implementations of an enhanced axial air mover system address various issues such as drying performance, transportability, storage, use, and assembly. Some implementations include ergonomic positioning of a carrying handle relative to positioning of a fan-assembly to make the system easier to carry. Implementations have enclosures with variable diameter profiles to increase air flow performance through the air mover. A floor edge allows for flush positioning of the air mover's outlet to improve flow of air after exhausted from the air mover. Various supports and engagement members allow for horizontal and/or vertical engagement of a plurality of the air movers for storage or increased air moving capacity for a given application. An alignment guide assists with positioning of the air mover with respect to a room wall to enhance air flow within the room. A cord retaining system provides an enhanced approach for securing the air mover's electrical cord. The air mover's grill guards have slotted ends to assist with assembly of the air mover.

Figure 1:
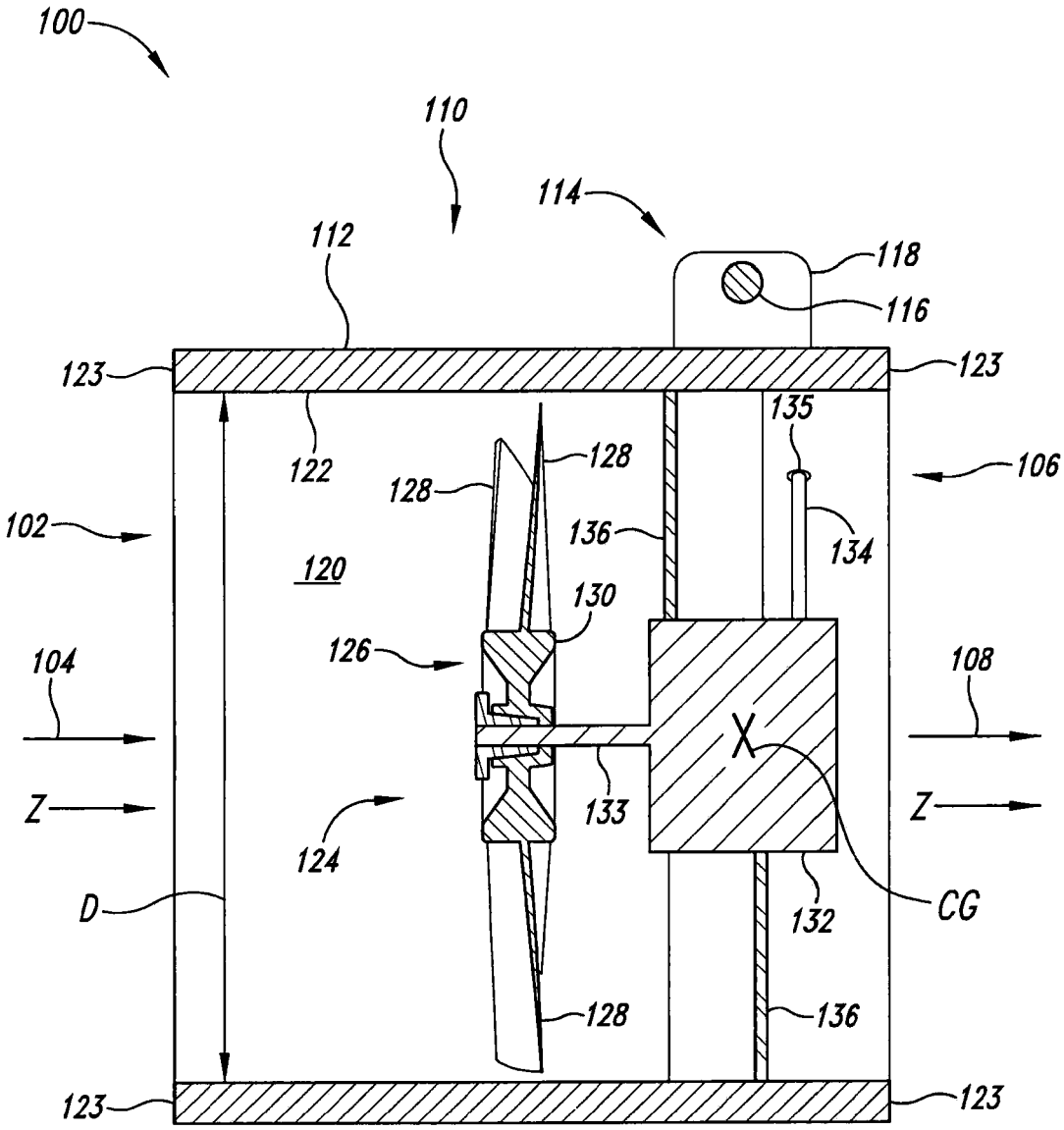
FIG. 1 is a cross-sectional elevational side view of a first fan-assembly version of an enhanced axial air mover system.

A first fan assembly version 100 of the enhanced axial air mover system is shown in FIG. 1 as having an inlet 102 to receive intake air 104 flowing toward the system in the direction of the Z-axis and an outlet 106 to release exhaust air 108 flowing from the system in the direction of the Z-axis. The first version 100 has a housing assembly 110 including an enclosure 112 and a handle 114 extending therefrom. The handle 114 includes a grip 116 and a bracket 118. The enclosure 112 has an interior 120 with an inner surface 122 depicted in FIG. 1 with a straight profile. The enclosure 112 has edges 123 on both the inlet 102 and the outlet 106 depicted in FIG. 1 as blunt. The first version 100 further includes a fan assembly 124 having a propeller 126 with blades 128 extending from a hub 130. The fan assembly also includes a motor 132 with a shaft 133 extending therefrom with the hub 130 attached thereto. The motor 132 has a power cord 134 protruding through a passageway 135 in the enclosure 112. The motor 132 is held in place relative to the enclosure 112 with support vanes 136 extending from the enclosure. The support vanes 136 are shaped to help guide the exhaust air 108 leaving the system.

As shown in FIG. 1, the motor 132 is located along the Z-axis substantially near the outlet 106. The propeller 126 is positioned in the interior 120 farther from the outlet 106 than the motor 132 is from the outlet. Since the motor 132 weighs significantly more than the propeller 126, the combined center of gravity (CG) of the motor and the propeller as the fan assembly 124 is located approximately near the center of the motor along the Z-axis as shown in FIG. 1. The grip 116 of the handle 114 is positioned along the Z-axis to be substantially aligned along a second dimension substantially perpendicular to the Z-axis with the center of gravity (CG) of the fan assembly 124 to allow for greater ease in transport of the system. In many implementations, the Z-axis is substantially horizontally oriented and the second dimension substantially perpendicular to the Z-axis is substantially vertically oriented with the system is being carried.

Figure 2:
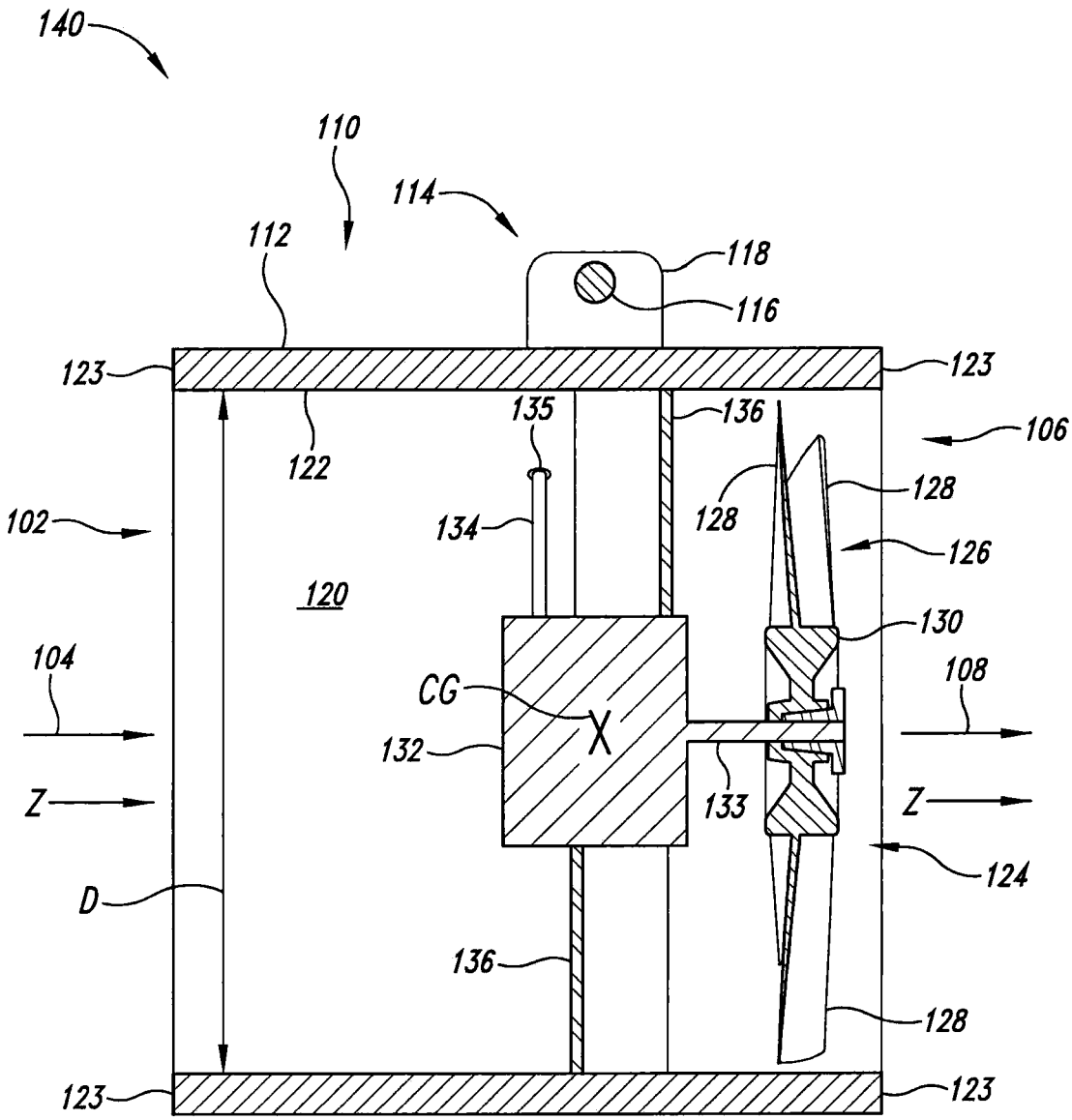
FIG. 2 is a cross-sectional elevational side view of a second fan-assembly version of the enhanced axial air mover system.

A second fan assembly version 140 is shown in FIG. 2 in which the propeller 126 is located substantially near the outlet 106 and the motor 132 is located farther from the outlet. The position of the grip 116 of the handle 114 along the Z-axis is changed in the second fan assembly version 140 to be aligned with the center of gravity (CG) of the fan assembly 124 of the second fan assembly version 140.

Figure 3:
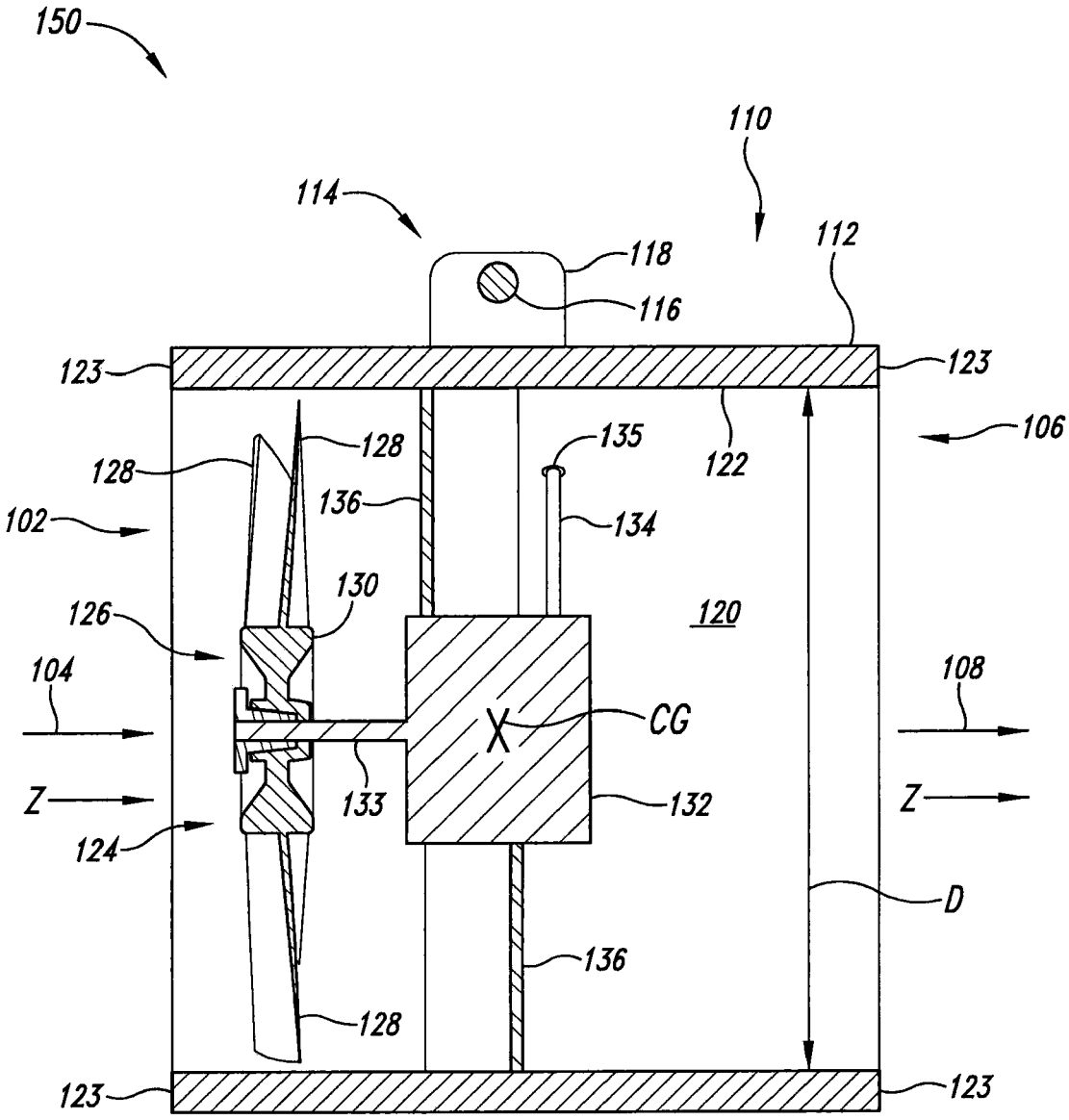
FIG. 3 is a cross-sectional elevational side view of a third fan-assembly version of the enhanced axial air mover system.

A third fan assembly version 150 is shown in FIG. 3 in which the propeller 126 is located substantially near the inlet 102 and the motor 132 is located farther from the inlet. The position of the grip 116 of the handle 114 along the Z-axis is changed in the third fan assembly version 150 to be aligned with the center of gravity (CG) of the fan assembly 124 of the third fan assembly version 150.

Figure 4:
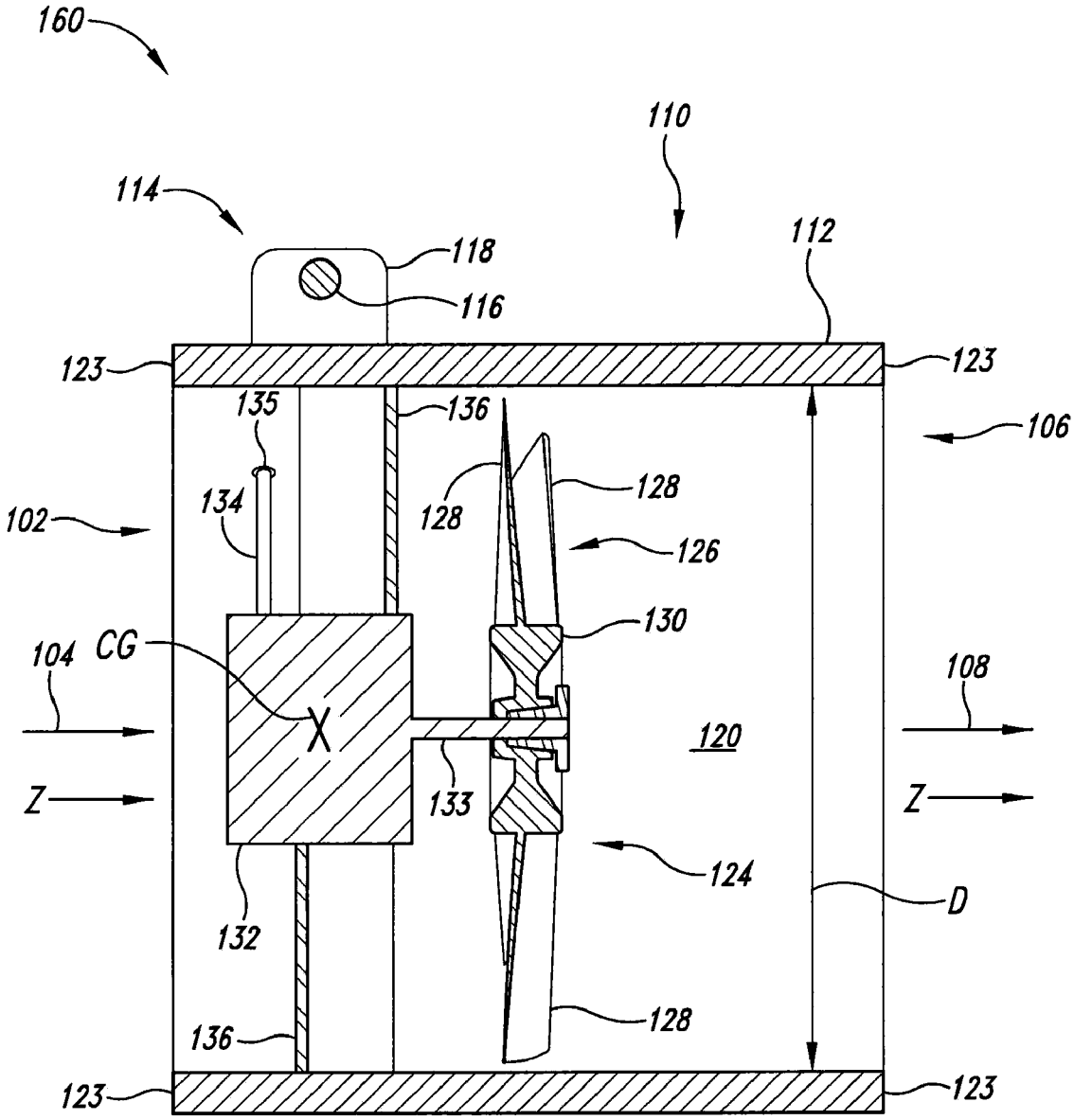
FIG. 4 is a cross-sectional elevational side view of a fourth fan-assembly version of the enhanced axial air mover system.

A fourth fan assembly version 160 is shown in FIG. 4 in which the motor 132 is located substantially near the inlet 102 and the propeller 126 is located farther from the inlet. The position of the grip 116 of the handle 114 along the Z-axis is changed in the fourth fan assembly version 160 to be aligned with the center of gravity (CG) of the fan assembly 124 of the fourth fan assembly version 160.

Figure 5:
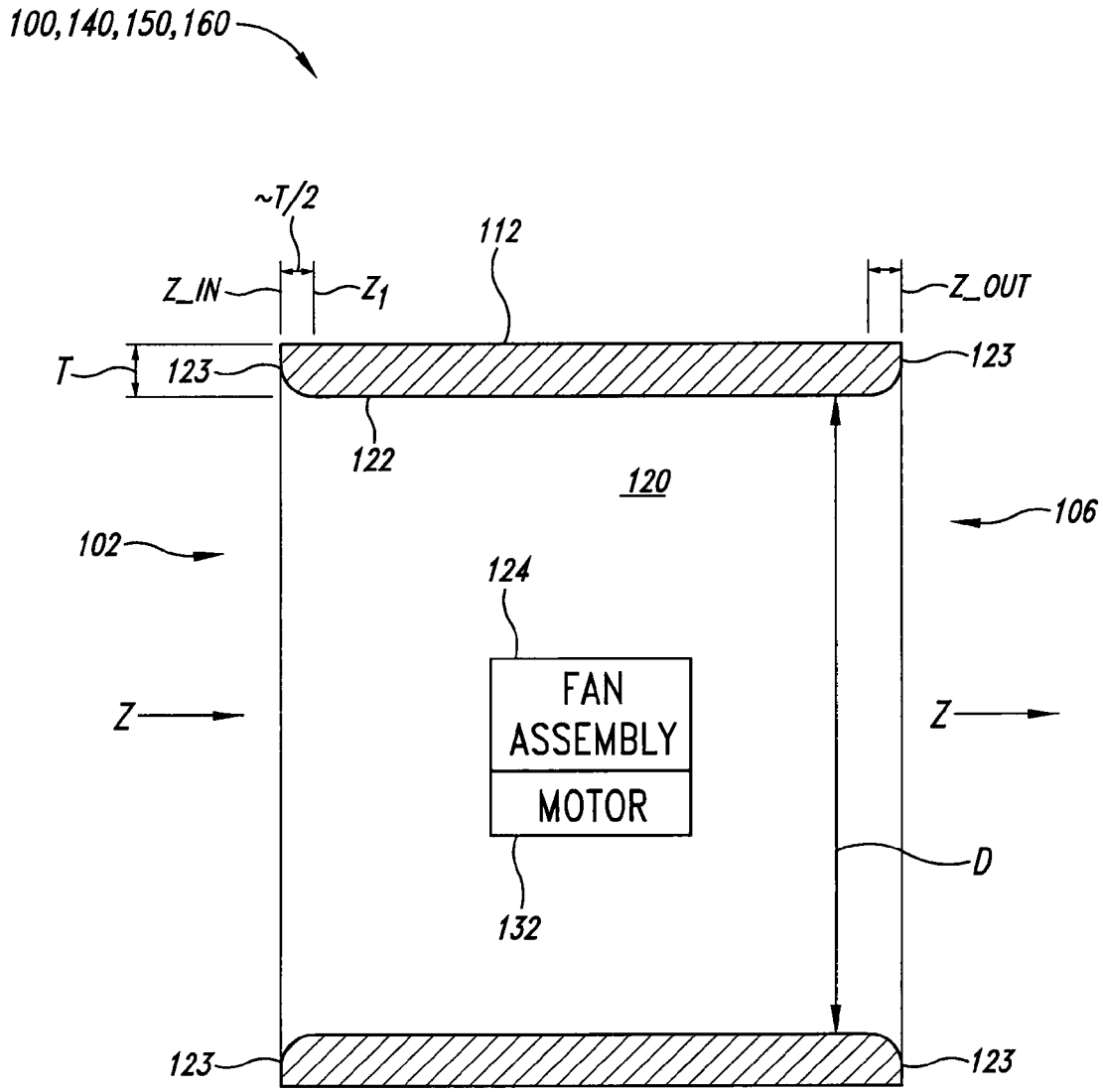
FIG. 5 is a cross-sectional elevational side view of the enhanced axial air mover system having radiused edges.

The enclosure 112 is shown in FIG. 5 as having a version of the edges 123 curved with a substantially constant radius such that the curve of the edge is sized approximately half the thickness, T, of the enclosure. The enclosure 112 of FIG. 5 is shown to house any one of the first fan assembly version 100, the second fan assembly version 140, the third fan assembly version 150, and the fourth fan assembly version 160. The enclosure 112 has a version of the inner surface 122 with a substantially straight profile.

Figure 6:
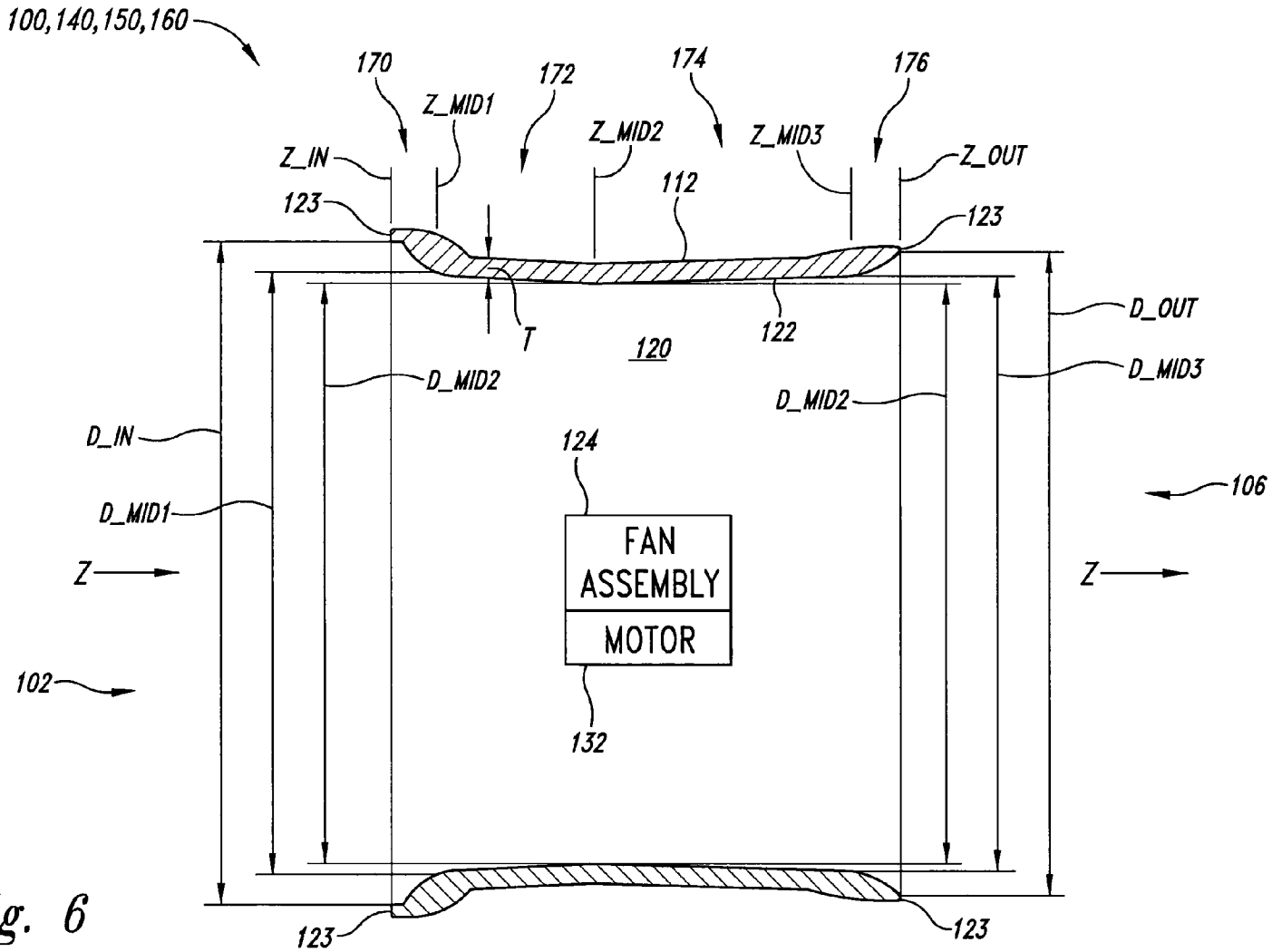
FIG. 6 is a cross-sectional elevational side view of the enhanced axial air mover system having tapered edges.

The enclosure 112 is shown in FIG. 6 as having a version of the edges 123 as tapered. The tapering of the edges 123 is such that for an inlet portion 170 of the enclosure, the diameter of the inner surface 122 changes from D_in at the inlet 102 to D_mid1 at the Z_mid1 location along the Z axis in from the inlet along the Z-axis. The change of diameter between D_in and D_mid1 for the inlet portion 170 can be at least as much as twice the average thickness, T, of the enclosure 112 in some implementations. In other implementations the change in diameter for the inlet portion 170 between D_in and D_mid1 is at least as much as five to ten percent of the diameter, D_in, at the inlet.

The diameter of the enclosure 112 continues to decrease along the Z-axis for a first mid-portion 172 of the enclosure from a diameter of D_mid1 at the Z_mid1 location to D_mid2 at the Z_mid2 location approximately near a mid location along the Z-axis so that the inner surface 122 has a substantially variable profile for the inlet portion 170 and the first mid-portion 172. Farther toward the outlet 106 along the Z-axis for a second mid-portion of the enclosure 112 from the Z_mid2 location to a Z_mid3 location, the diameter of the enclosure 112 increases gradually from D_mid2 at the Z_mid2 location to D_mid3 at the Z_mid3 location. For an outlet portion 176 of the enclosure 112 the diameter of the enclosure increases more abruptly from D_mid3 at the Z_mid3 location to D_out at the outlet 106 so that the inner surface 122 has a substantially variable profile between the second mid-portion 174 and the outlet portion 176. In some implementations, the change in diameter between D_mid3 and D_out can be at least half as great as the change in diameter between D_in and D_mid1. The enclosure 112 of FIG. 6 is shown to house any one of the first fan assembly version 100, the second fan assembly version 140, the third fan assembly version 150, and the fourth fan assembly version 160.

Figure 7:
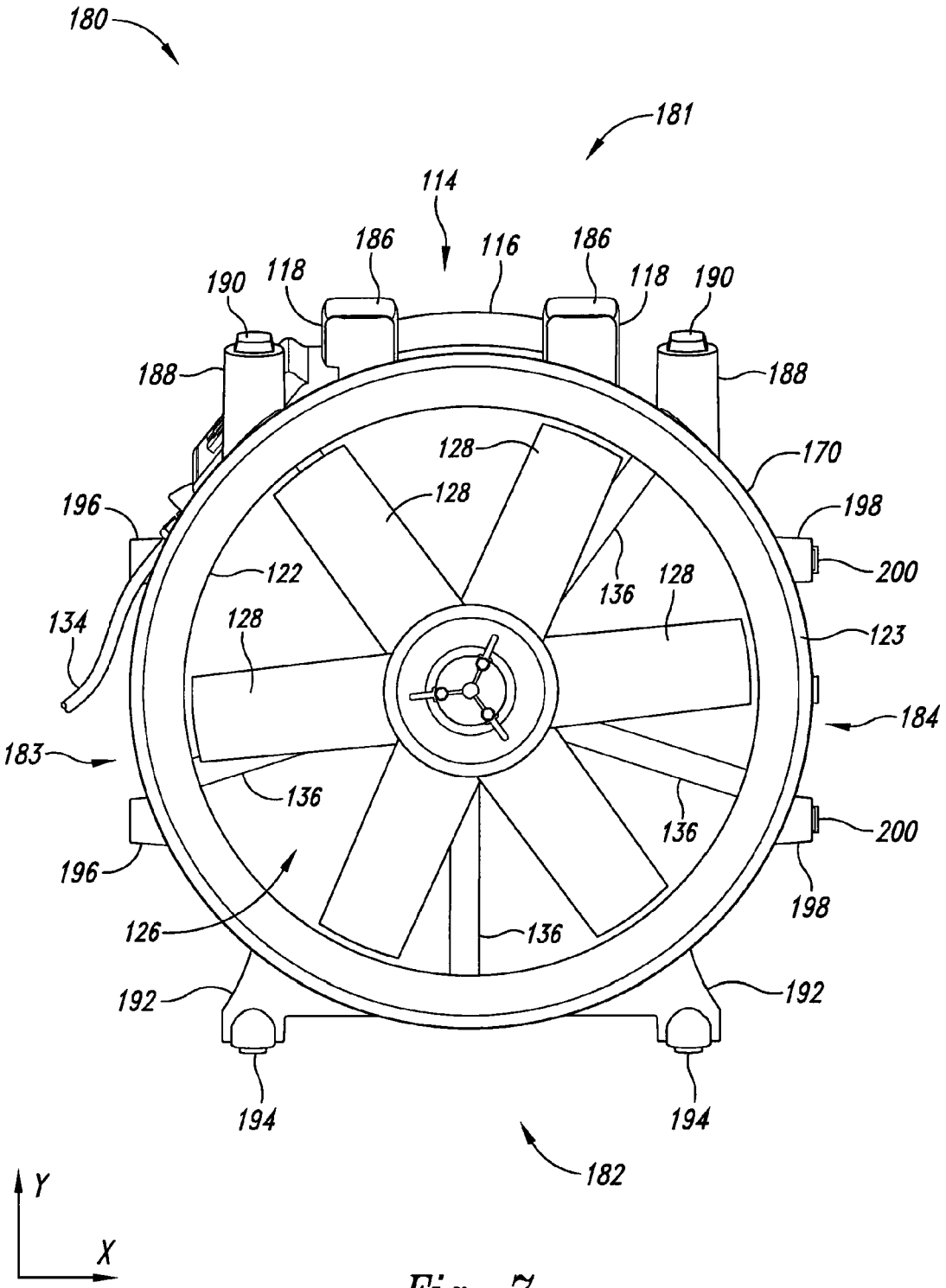
FIG. 7 is an elevational inlet view of an augmented implementation of the first fan-assembly version of the enhanced axial air mover system.

An augmented implementation 180 of the first fan-assembly version 100 is shown in FIG. 7 as having a top 181, a bottom 182, a port 183, and a starboard 184. The bracket 118 of the handle 114 has a platform 186 to support an additional one of the augmented implementation 180 positioned above the depicted augmented implementation as further described below. Two vertical supports 188 extend upward from the top 181 to further support the additional above-positioned one of the augmented implementation 180. Each of the vertical supports 188 has a peg 190 to engage with the additional above-positioned one of the above augmented implementation 180.

Extending from the bottom 182 are two legs 192 each having a floor guard 194 to support the inlet portion 170 and the first mid-portion 172 on a floor. Extending from the port 183 are port supports 196. Extending from the starboard 184 are starboard supports 198. The starboard support 198 is further shown to have a peg 200 for engagement with the port support of another of the augmented implementations 180.

Figure 8:
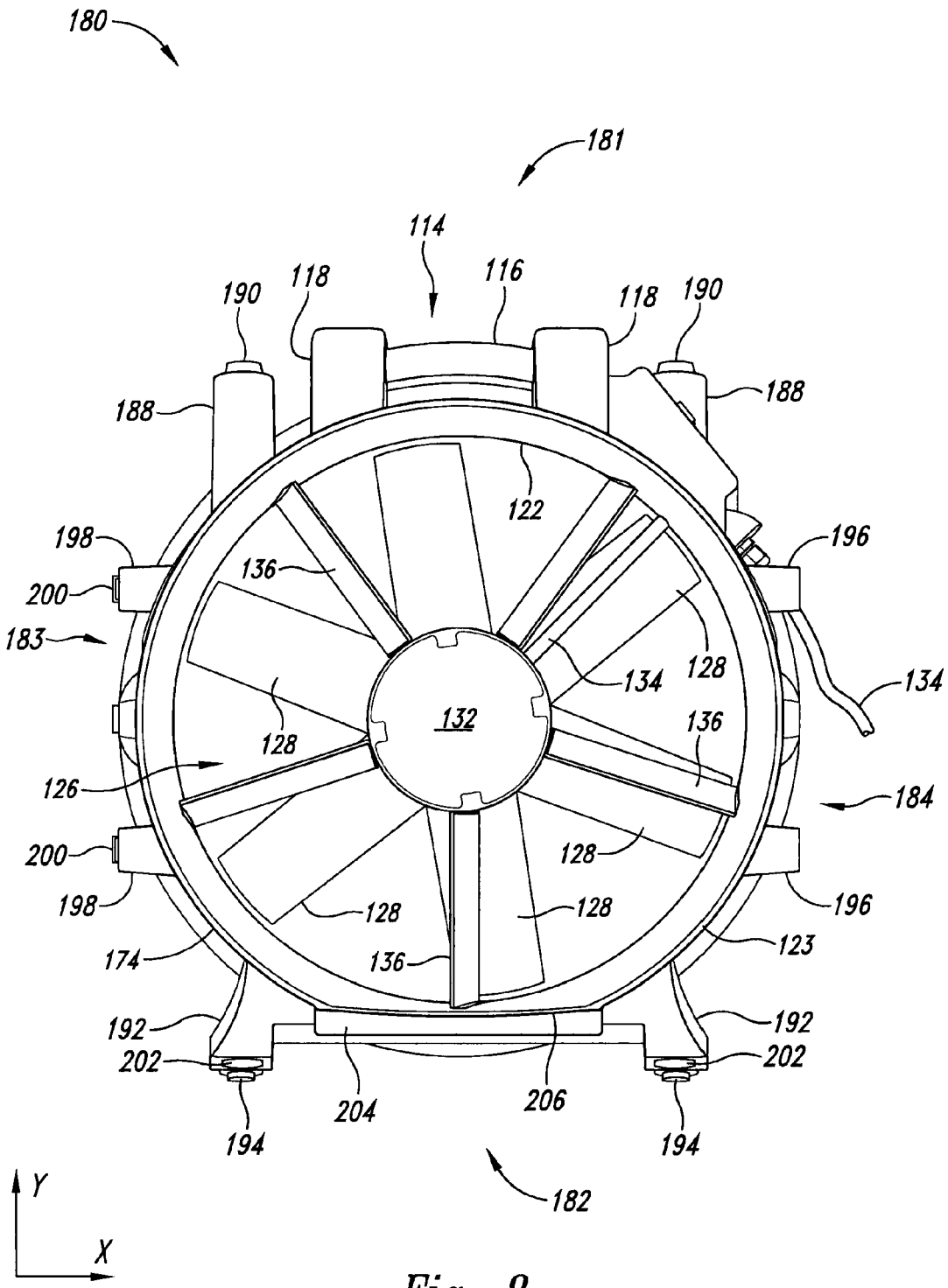
FIG. 8 is an elevational outlet view of the augmented implementation of the enhanced axial air mover system of FIG. 7.

In FIG. 8, the augmented implementation 180 is shown to have an opening 202 in each of the legs 192 to receive the peg 190 of one of the vertical supports 188 of a lower-positioned one of the augmented implementations 180. The augmented implementation 180 has a support pad 204 that rests on the platform 186 of a lower-positioned augmented implementation. The augmented implementation 180 has a floor edge to allow for a more flush positioning of the inlet portion 102 with a floor of a room. As discussed herein, a more flush positioning allows for enhanced flow of the exhaust air 108.

Figure 9:
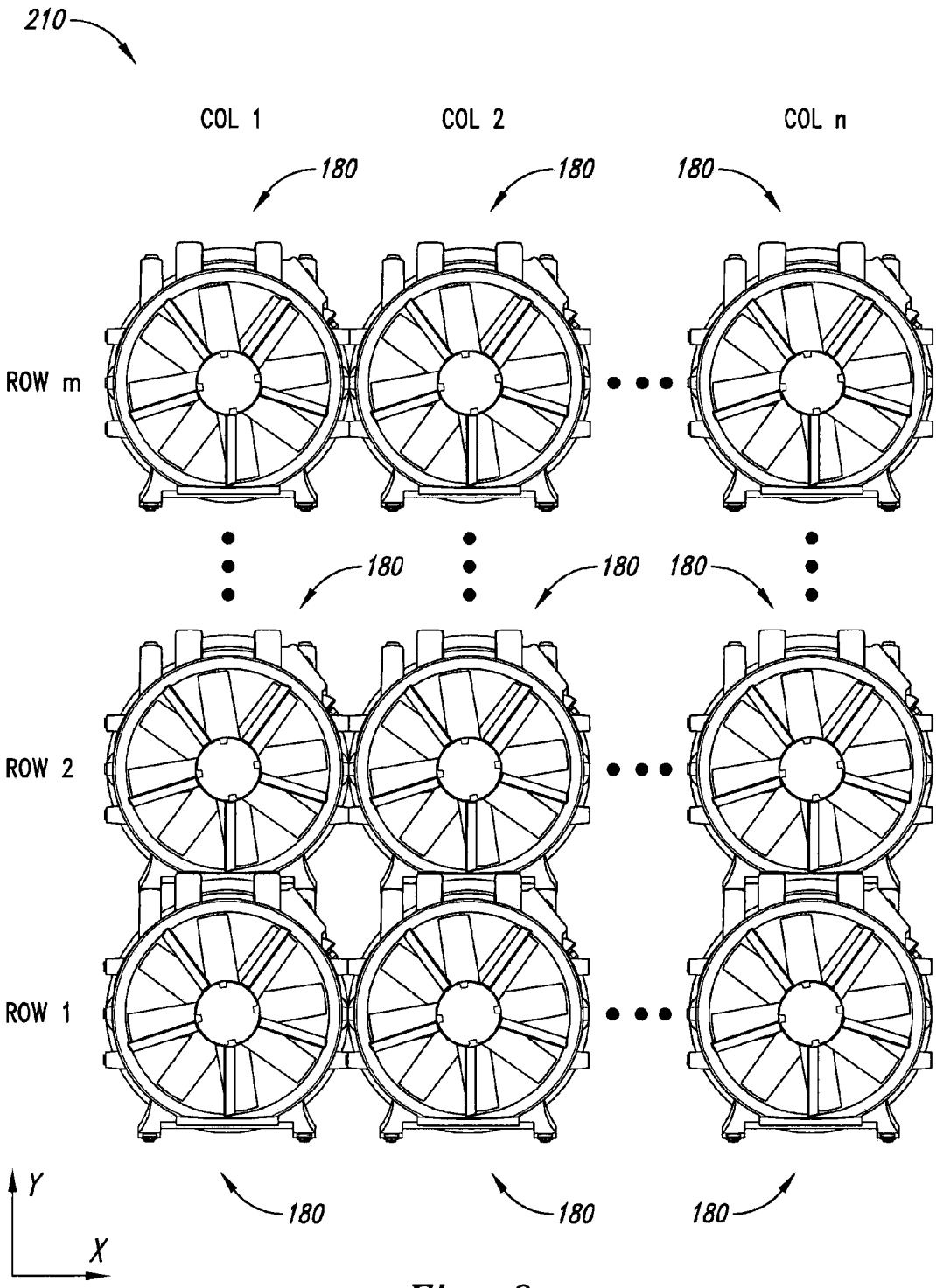
FIG. 9 is an elevational outlet view of a matrix configuration of a plurality of the augmented implementations of FIG. 7.

The matrix 210 having m rows by n columns of a plurality of instances of the augmented implementation 180 is shown in FIG. 9. The port supports 196 of the first column of the augmented implementations 180 are engaged with respective ones of the starboard supports 198 of the second column of the augmented implementations and so on for other adjacent columns of the augmented implementations of the matrix 210.

The support pads 204 of the second row of the augmented implementations 180 rest upon the respective platforms 186 of the first row of the augmented implementations and so on for other adjacent rows of the matrix 210. The pegs 190 of the vertical supports 188 of the first row of the augmented implementations 180 engage with the respective openings 202 of the legs 192 of the augmented implementations of the second row of the matrix 210.

Figure 10:
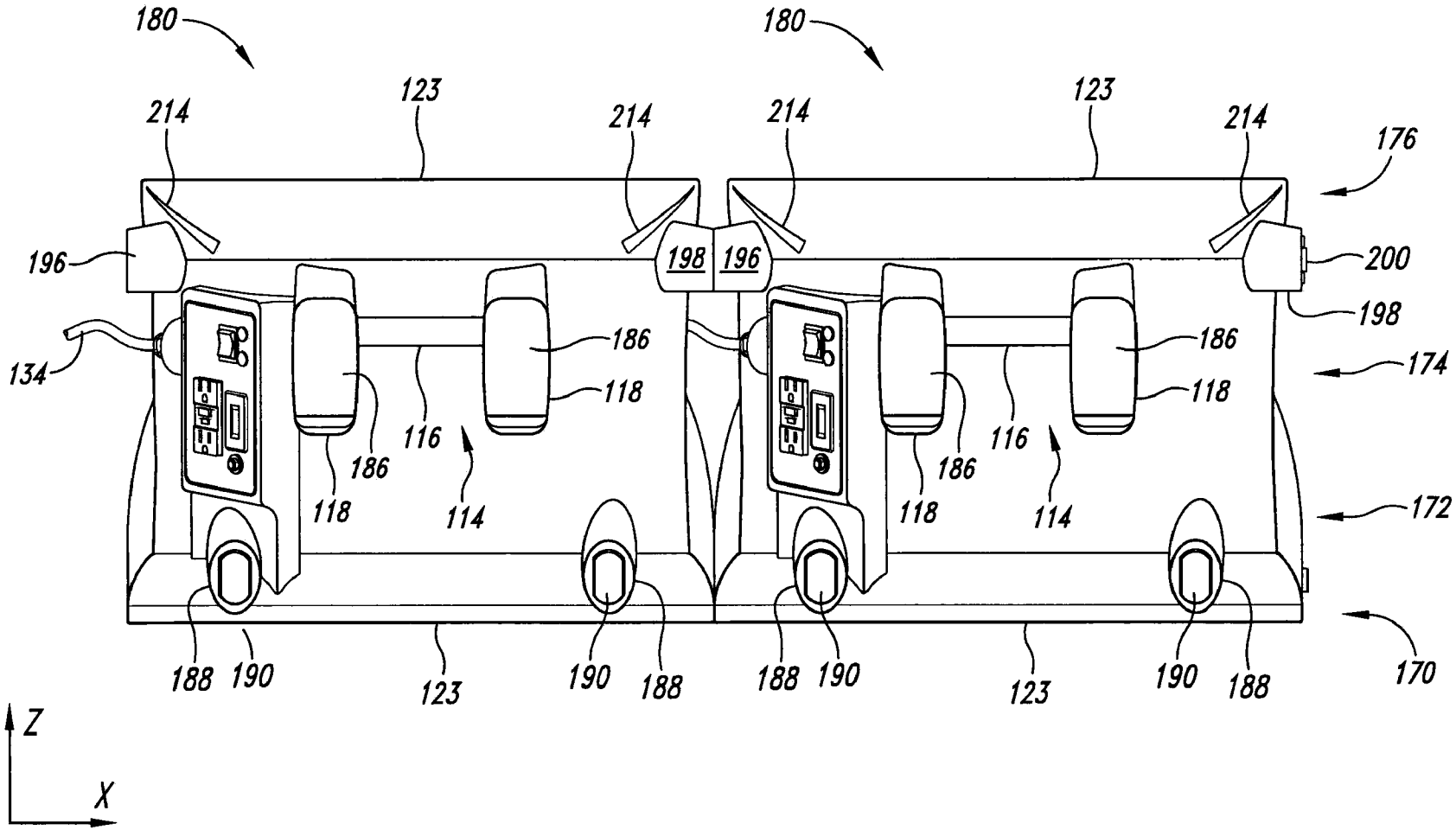
FIG. 10 is a top plan view of an engaged pair of the augmented implementations of FIG. 7.
Figure 11:
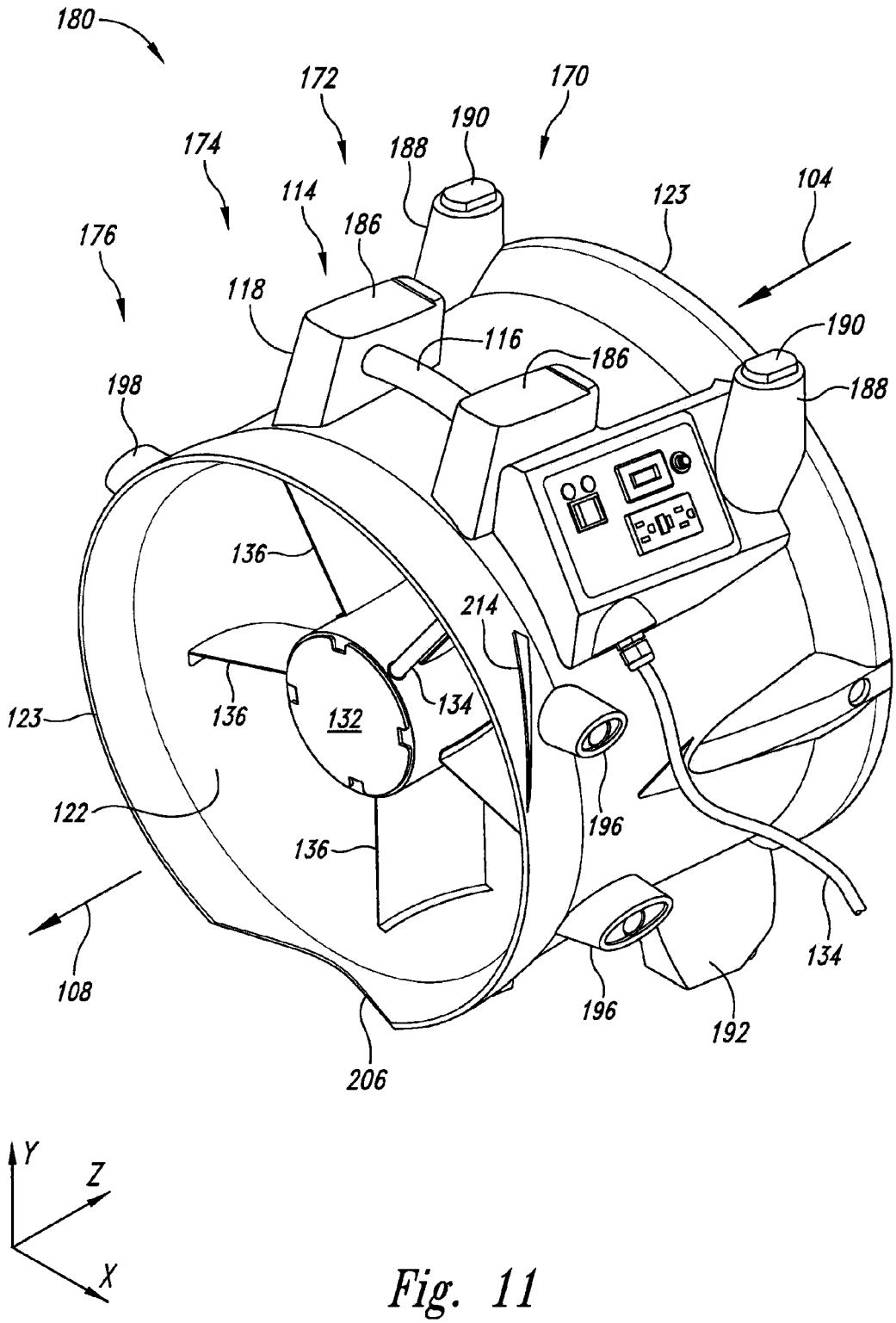
FIG. 11 is a top-outlet perspective port side view of the augmented implementation of FIG. 7.
Figure 12:
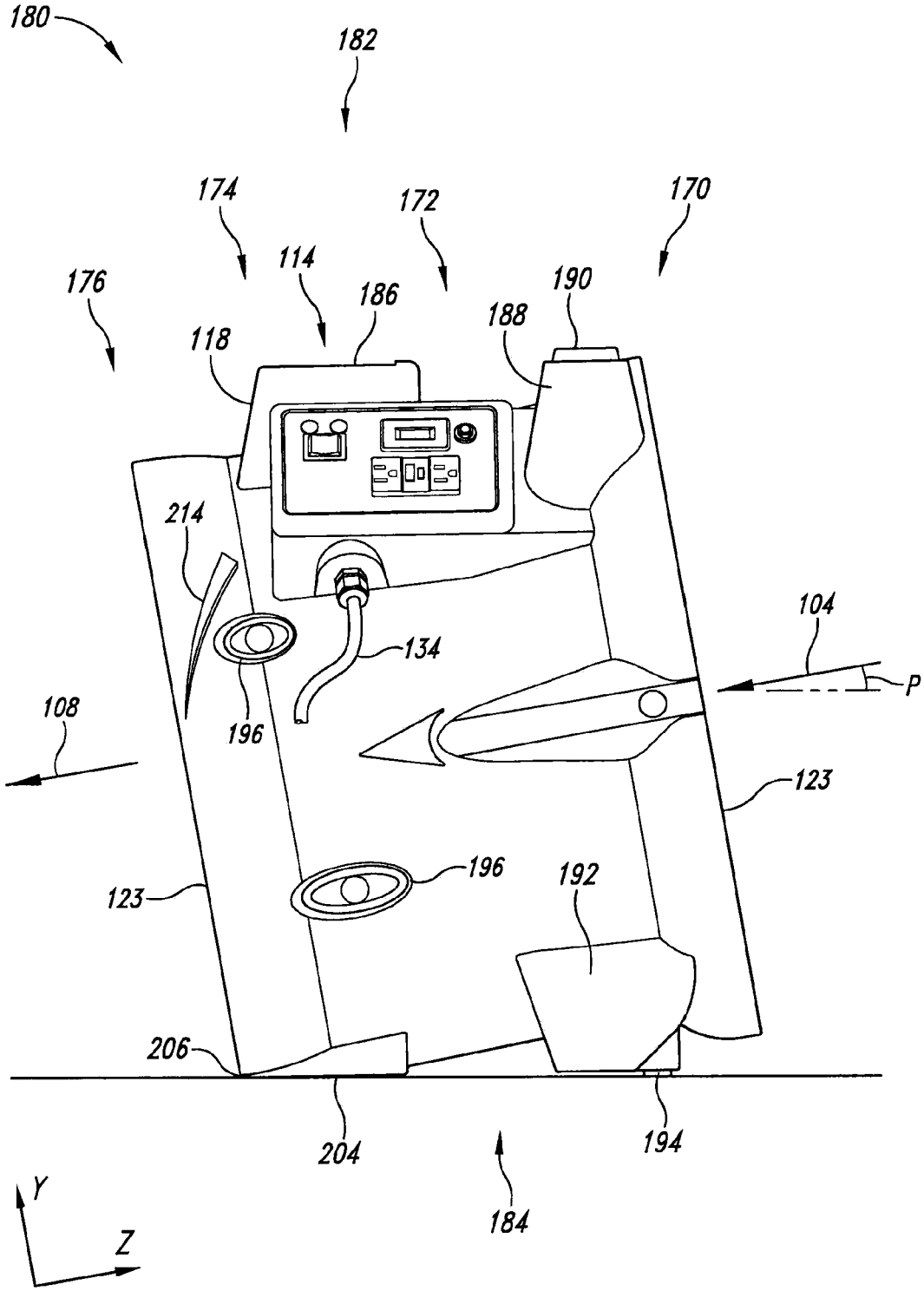
FIG. 12 is an elevational port side view of the augmented implementation of FIG. 7.

Various subsets of the matrix 210 can be implemented such as having a single row or a single column. For instance, a single row could have as little as two of the augmented implementations 180 coupled together as shown in FIG. 10. Alignment guides 214, further discussed herein, are shown on the top of the outlet portion 176 of the augmented implementations 180.

The floor edge 206 and associated downward pitch of the outlet portion 176 relative to the inlet portion 170 of the augmented implementation 180 is better shown in FIG. 11 through FIG. 14. The floor edge 206 allows the outlet portion 176 of the augmented implementation to be pitched down toward a floor surface relative to the inlet portion 170. Instead of the outlet portion 176 being completely circular near the outlet 106, a section of the outlet portion is missing. The missing section forming the floor edge 206 of the outlet portion 176 is shaped as though a horizontal slice is taken through the outlet portion near the bottom 182 of the augmented implementation 180 as the outlet portion is being pitched downward relative to the inlet portion 170. The floor edge 206 allows more of the outlet portion 276 to be flush with a floor, in comparison to a case in which the outlet 106 was completely circular thereby allowing an increase in air flow near the floor surface of the exhaust air 108 leaving the outlet.

Figure 15:
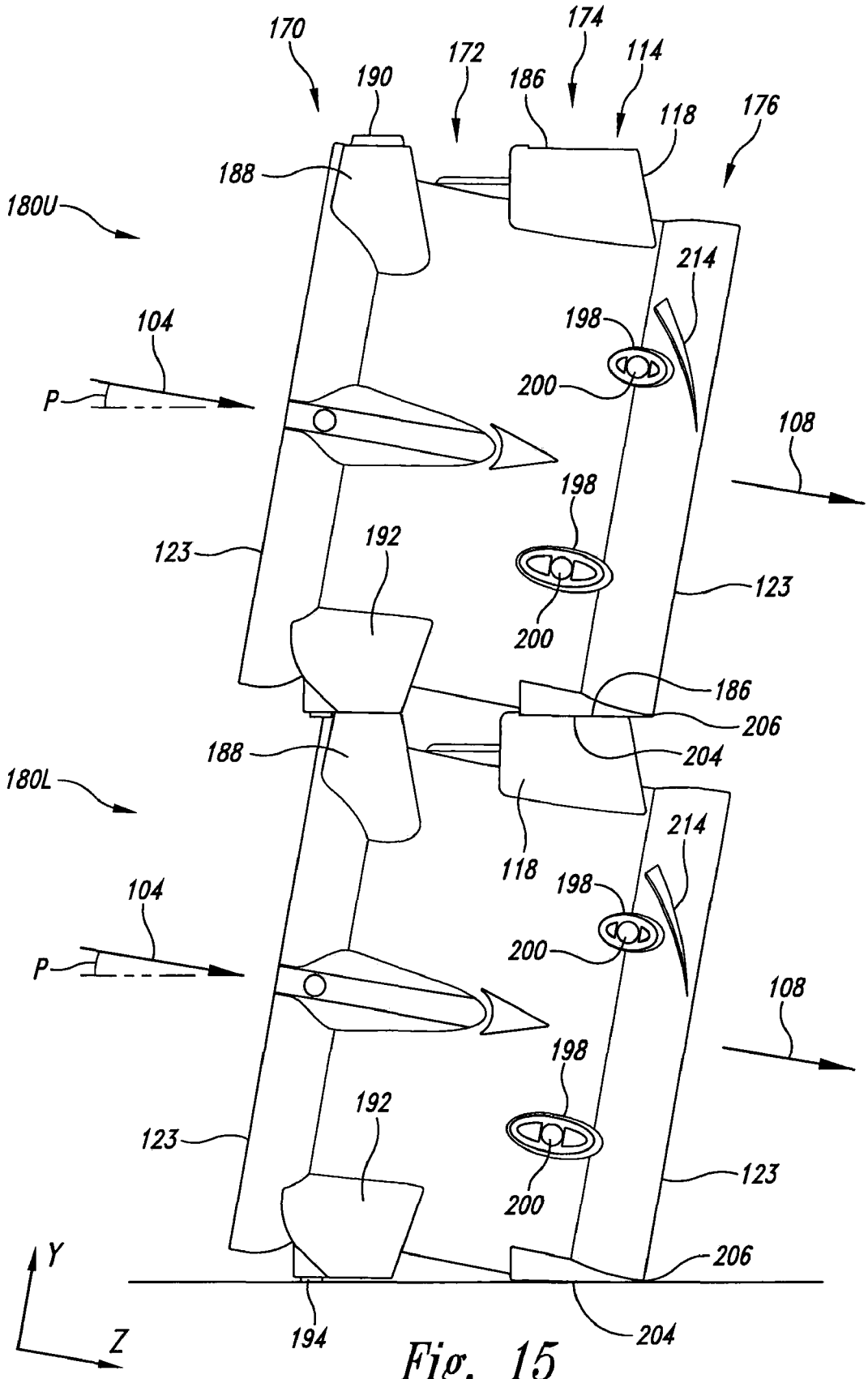
FIG. 15 is an elevational starboard side view of a vertically stacked pair of the augmented implementations of FIG. 7.

As shown in FIG. 15, for a column of a pair of an upper one 180*u* of the augmented implementations 180 of the pair and a lower one 180*l* of the augmented implementations of the pair, the legs 192 and the support pad 204 of the upper one are sized and positioned relative to the platform 186 and the vertical supports 188 of the lower one so that the pitch angle, P, for each of the augmented implementations of the column pair is substantially the same.

Figure 16:
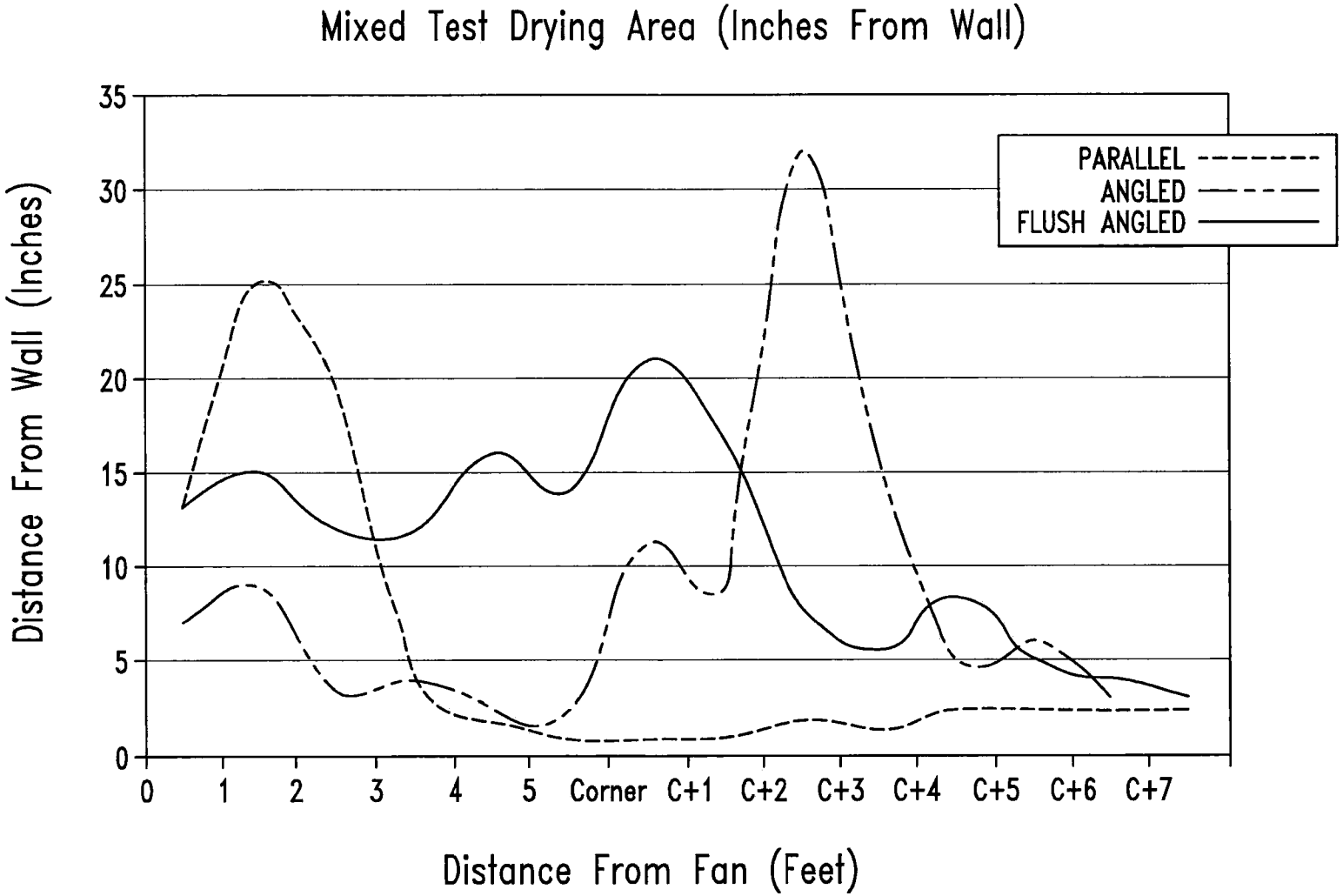
FIG. 16 is a drying performance chart.

A drying performance graph of FIG. 16 shows total floor area dried as area under a curve for three configurations: 1.) parallel, 2.) angled, and 3.) flush angled. The parallel configuration is similar to the augmented implementation 180, however, without the outlet portion 176 pitched downward relative to the inlet portion 170 and without the floor edge 206. The angled configuration is similar to the augmented implementation 180 having the outlet portion 176 being pitched downward relative to the inlet portion 170, but without the floor edge 206. The flush angled configuration is similar to the augmented implementation 180 having the outlet portion 176 being pitched downward relative to the inlet portion 170 and having the floor edge 206.

As shown by the graph of FIG. 16, the parallel configuration has the least amount of area under its curve indicating that the least amount of floor area was dried with this configuration. The angled configuration has about the same amount of drying area as the parallel configuration except for a large drying area away from the angled configuration air blower as airflow turns a corner of a room. The flush angled configuration has the most area under the curve indicating that the flush angled configuration has the most drying area. The flush angled configuration also has relatively even drying area and the most drying area near the air blower of the three configurations depicted.

Figure 13:
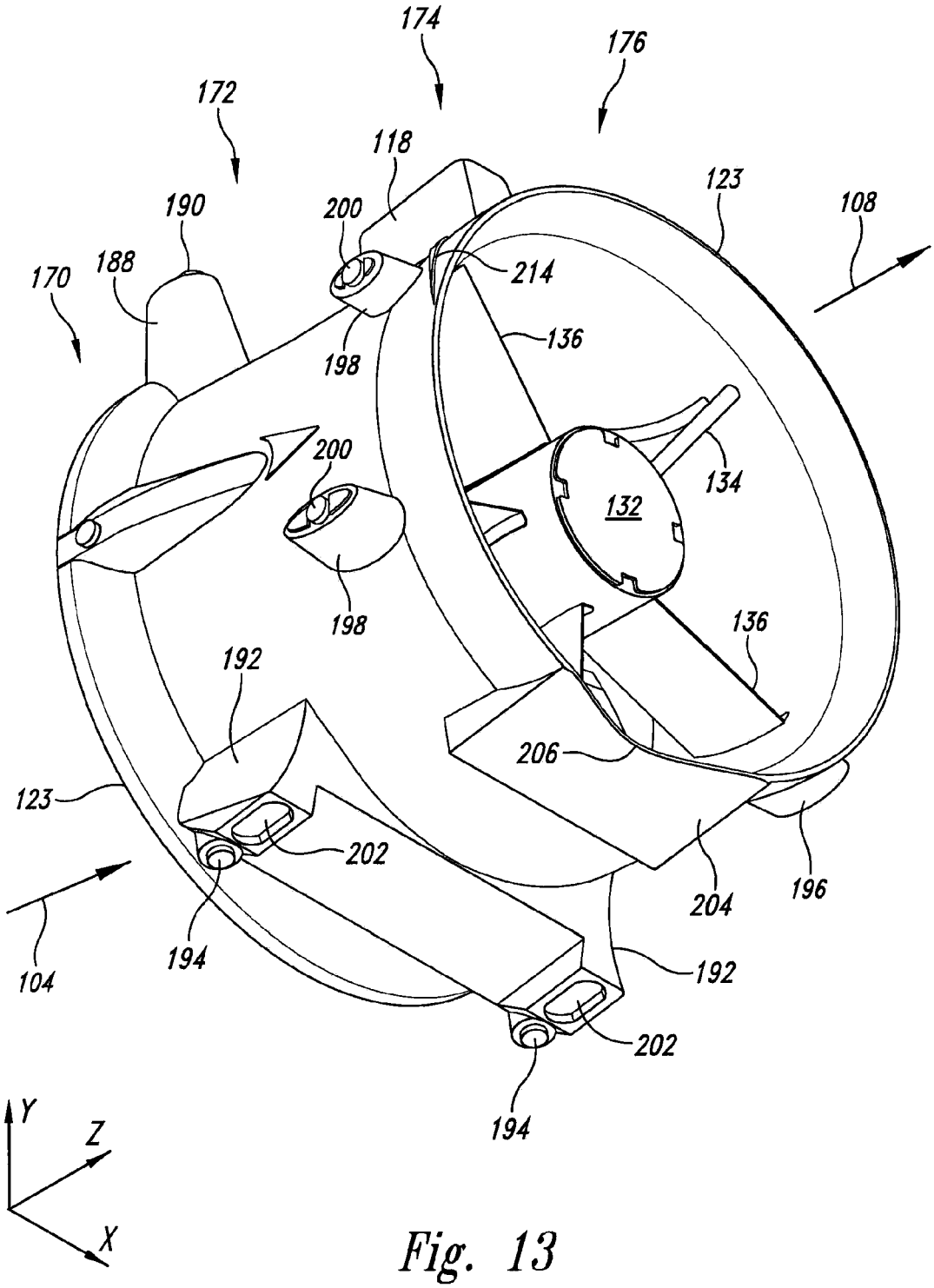
FIG. 13 is a bottom-outlet perspective starboard side view of the augmented implementation of FIG. 7.
Figure 14:
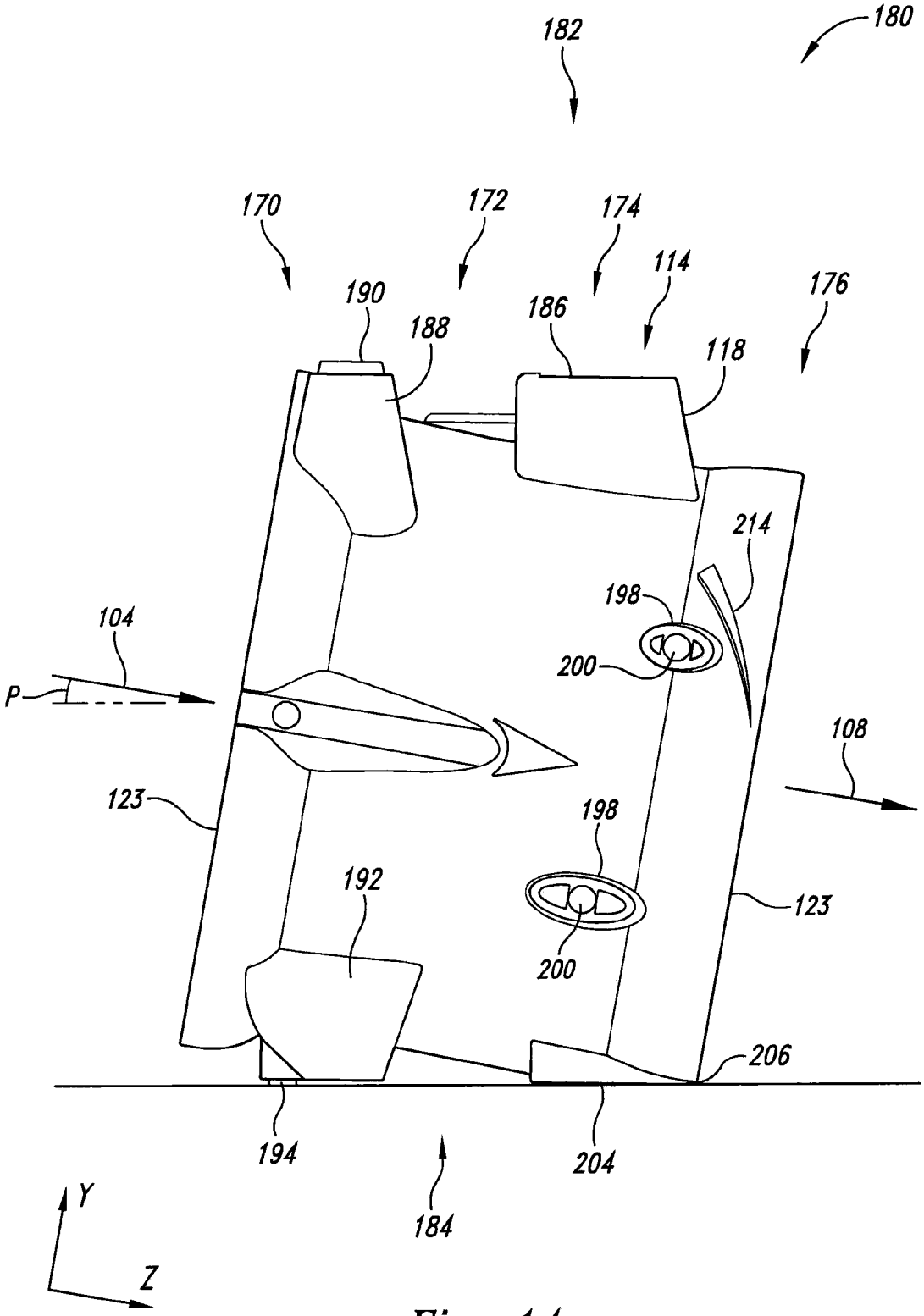
FIG. 14 is an elevational starboard side view of the augmented implementation of FIG. 7.
Figure 17:
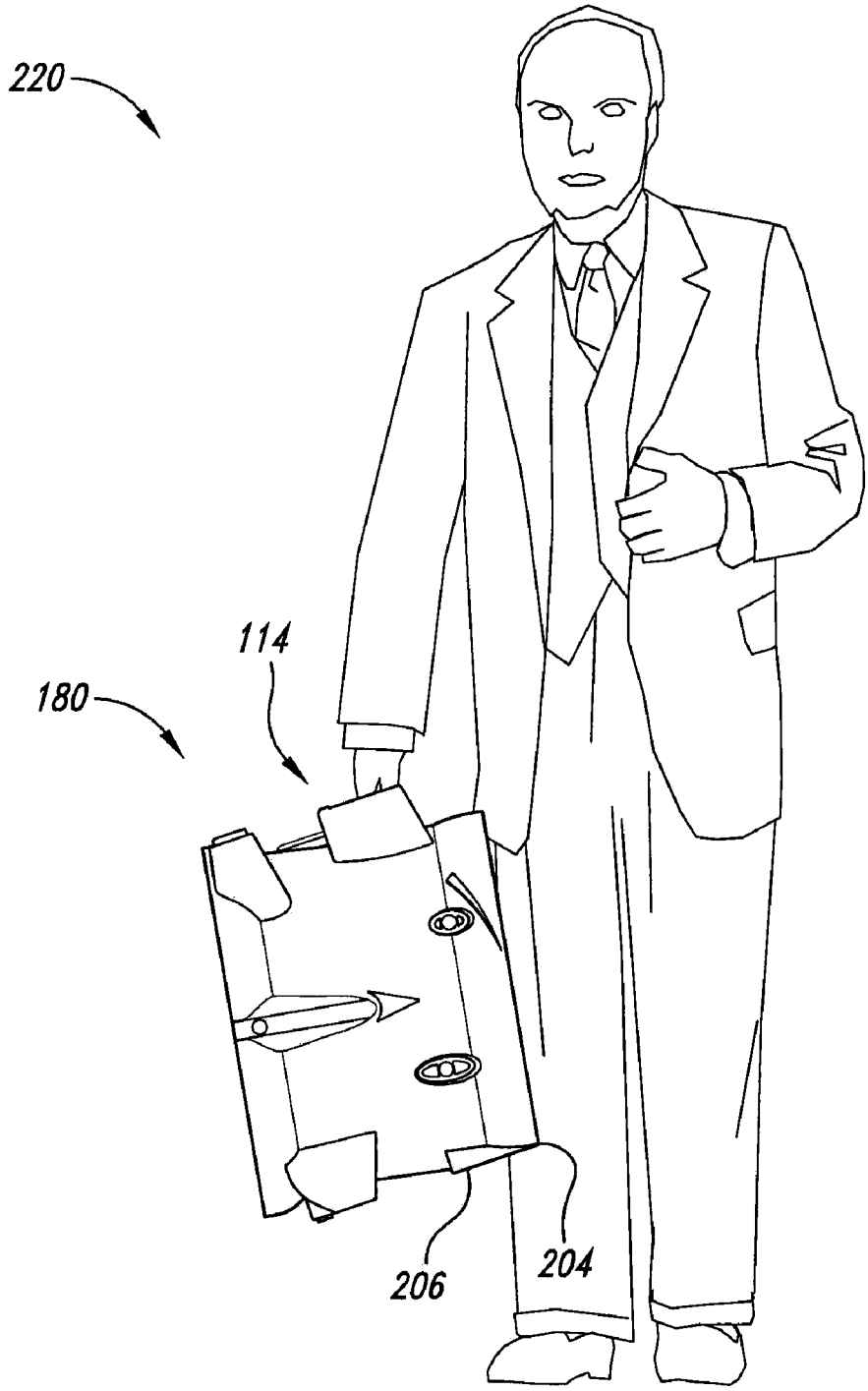
FIG. 17 is an elevational front view of person carrying the augmented implementation of FIG. 7.

As shown in previous figures such as FIG. 13, to conform with a plane of the floor when the outlet portion 176 is pitched, the floor edge 206 is shaped as a curvilinear cut of the circular outlet 106. The curvilinear cut of the floor edge 206 can be used to another advantage for carrying the augmented implementation 180 as shown in FIG. 17. Since both the handle 114 and the floor edge 206 are located near or at the outlet 106, the curvilinear aspect of the floor edge can be used to position the augmented implementation 180 in a more ergonomic position for transport. By allowing the floor edge 206 to be positioned near the leg or other portion of an individual carrying the augmented implementation, the arm used to carry can be brought closer to the torso resulting in a more comfortable position for carrying the augmented implementation.

Figure 18:
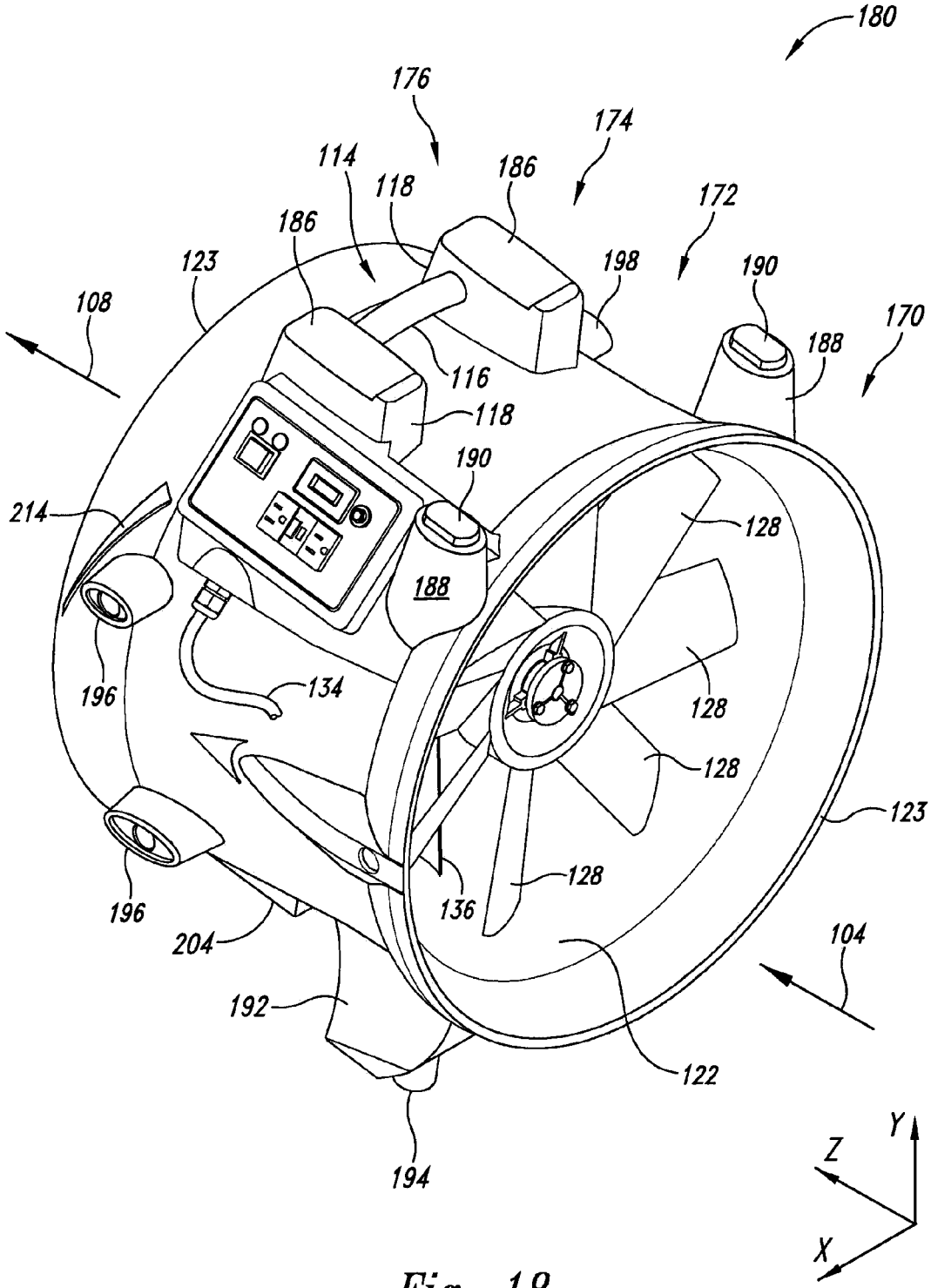
FIG. 18 is a top-inlet perspective port side view of the augmented implementation of FIG. 7.
Figure 19:
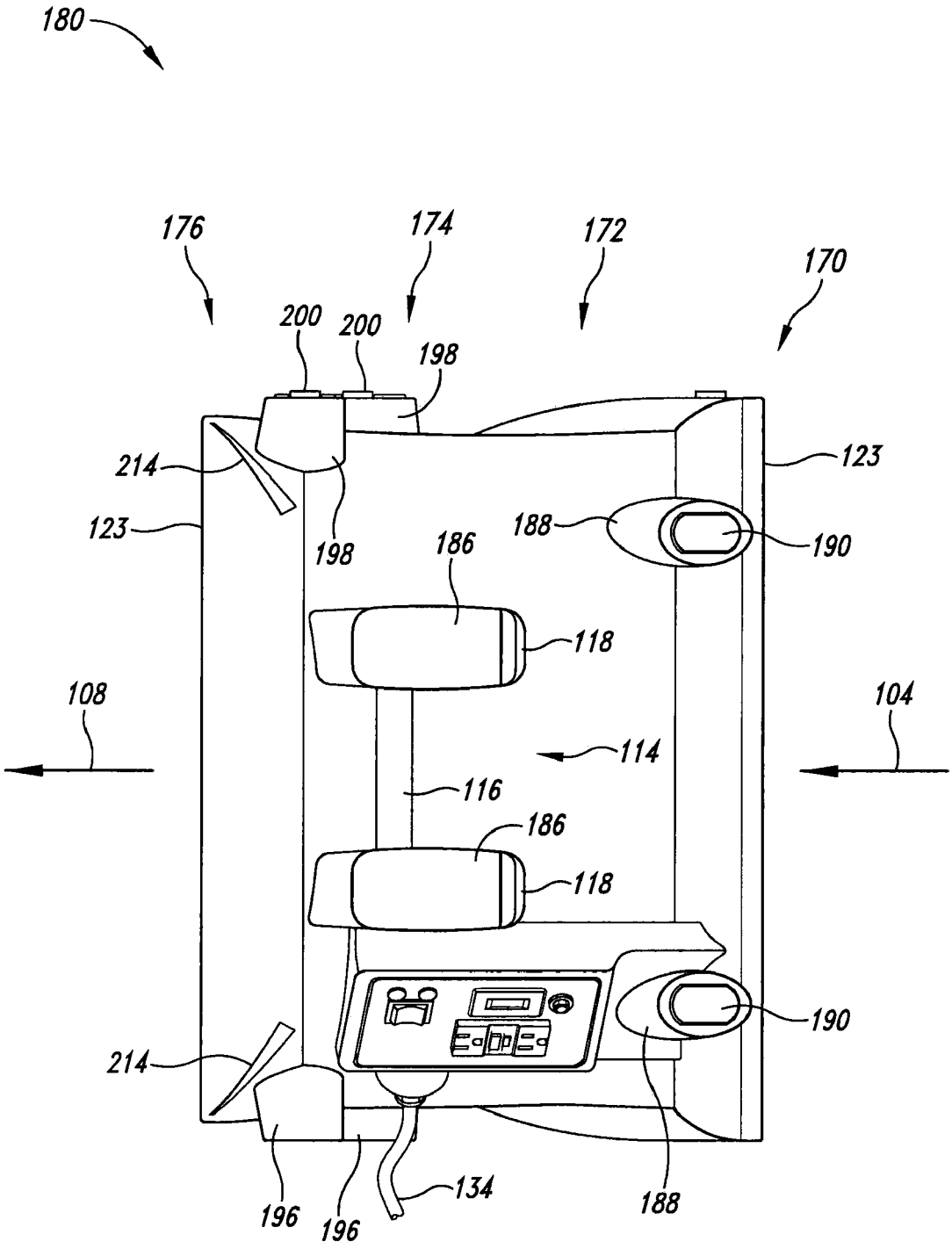
FIG. 19 is a top plan view of the augmented implementation of FIG. 7.
Figure 20:
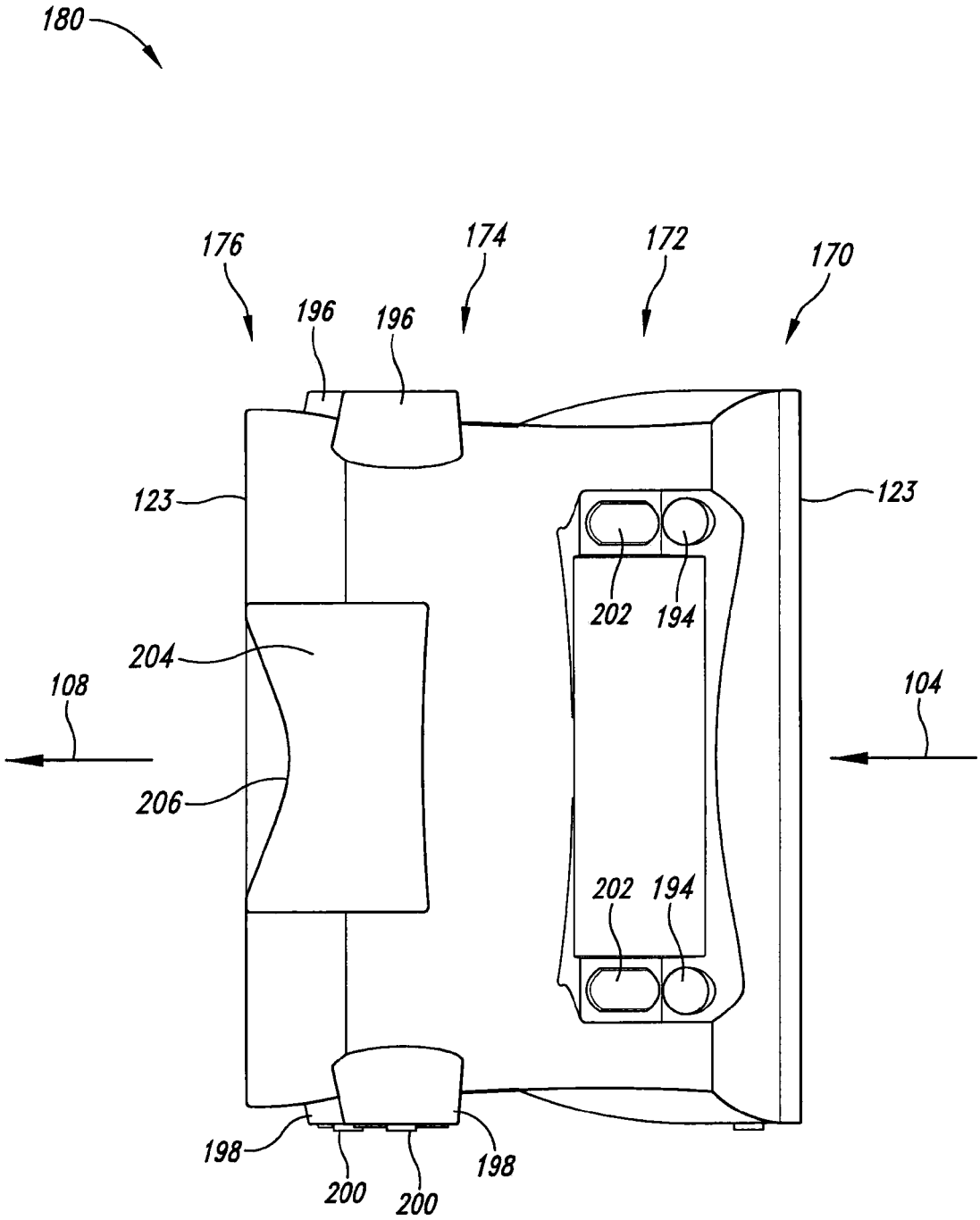
FIG. 20 is a bottom plan view of the augmented implementation of FIG. 7.

The variable profile for the inlet portion 170 of the augmented implementation 180 is indicated in FIG. 18. The variable profiles for the inlet portion 170, the first mid-portion 172, the second mid-portion 174, and the outlet portion 176 are indicated in FIG. 19 and FIG. 20.

Figure 21:
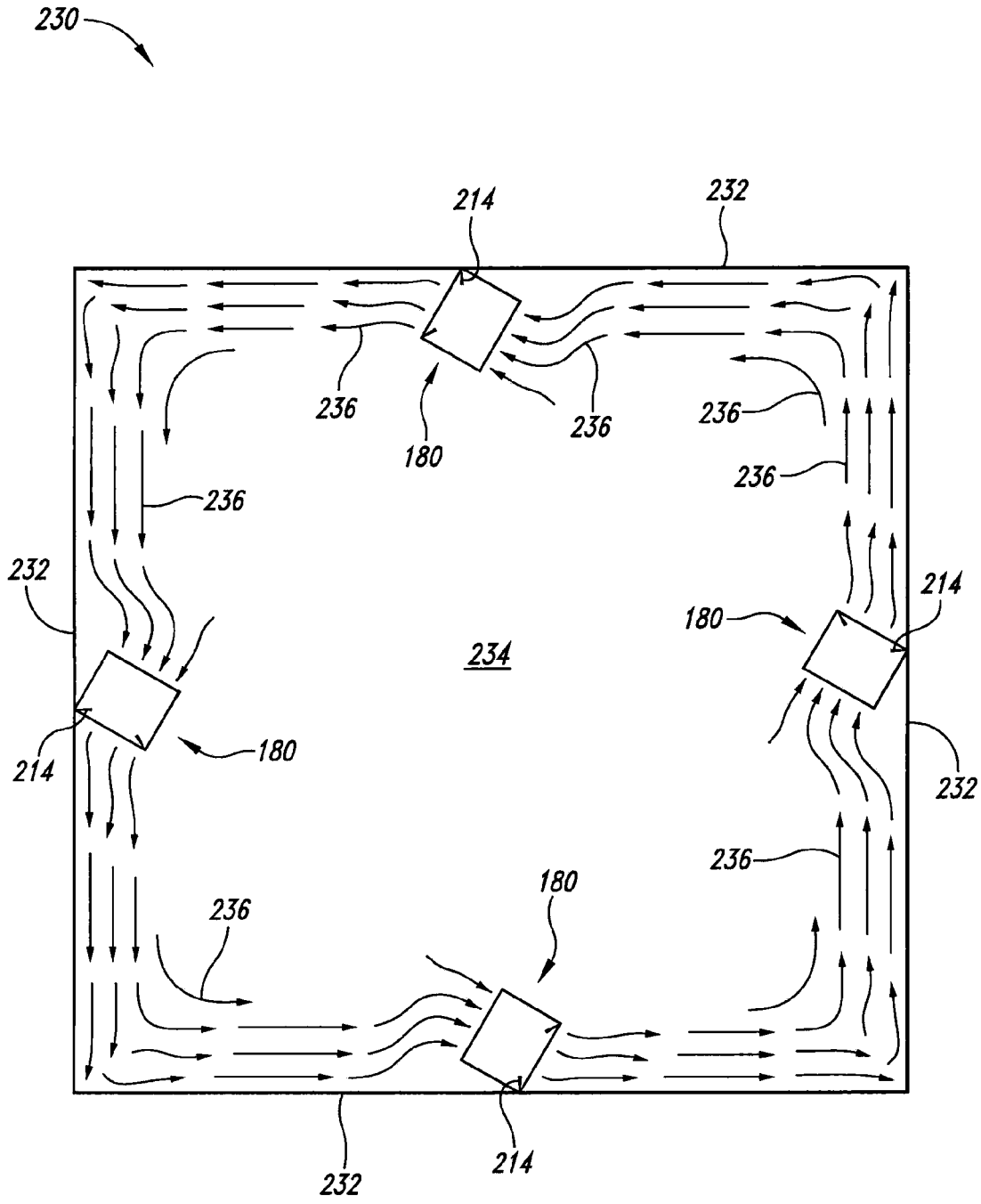
FIG. 21 is a top view of a room being dried by four of the augmented implementations of FIG. 7 showing airflow.
Figure 22:
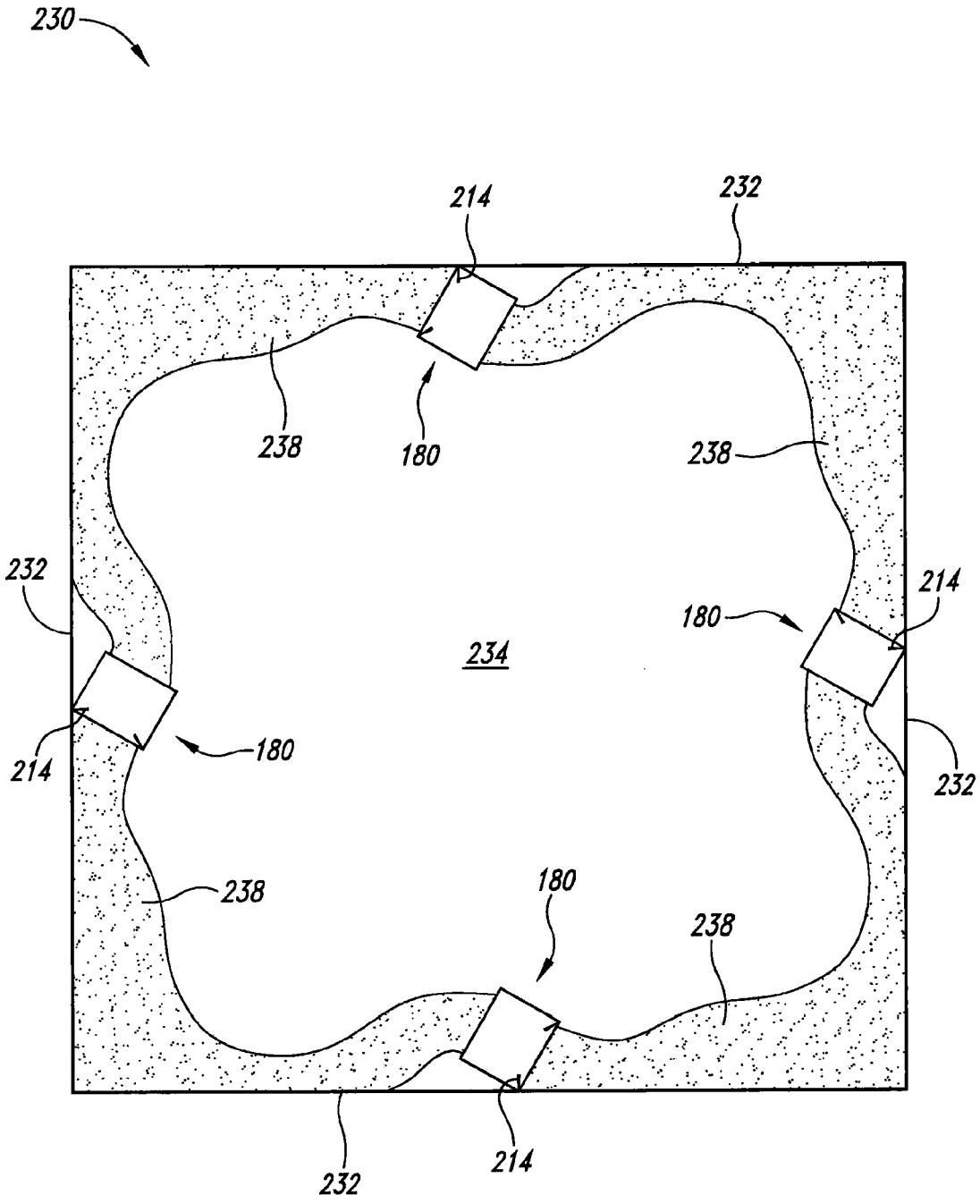
FIG. 22 is a top view of the room being dried by the four augmented implementations of FIG. 7 showing drying area.

An example of placement of the augmented implementation 180 in a room 230 with walls 232 and a floor 234 to be dried is shown in FIG. 21 and FIG. 22. By placing each of the augmented implementations 180 at a predetermined angle such as an acute angle, (such as approximately 30° for a version of the augmented implementation) with a different one of the walls 232, air flow 236 is distributed in a relatively uniform manner along the walls 232 and across the floor 234. The relatively uniform distribution of the air flow 236 results in a relatively large and evenly distributed dried area 238 of the floor 234 as shown in FIG. 22.

Figure 23:
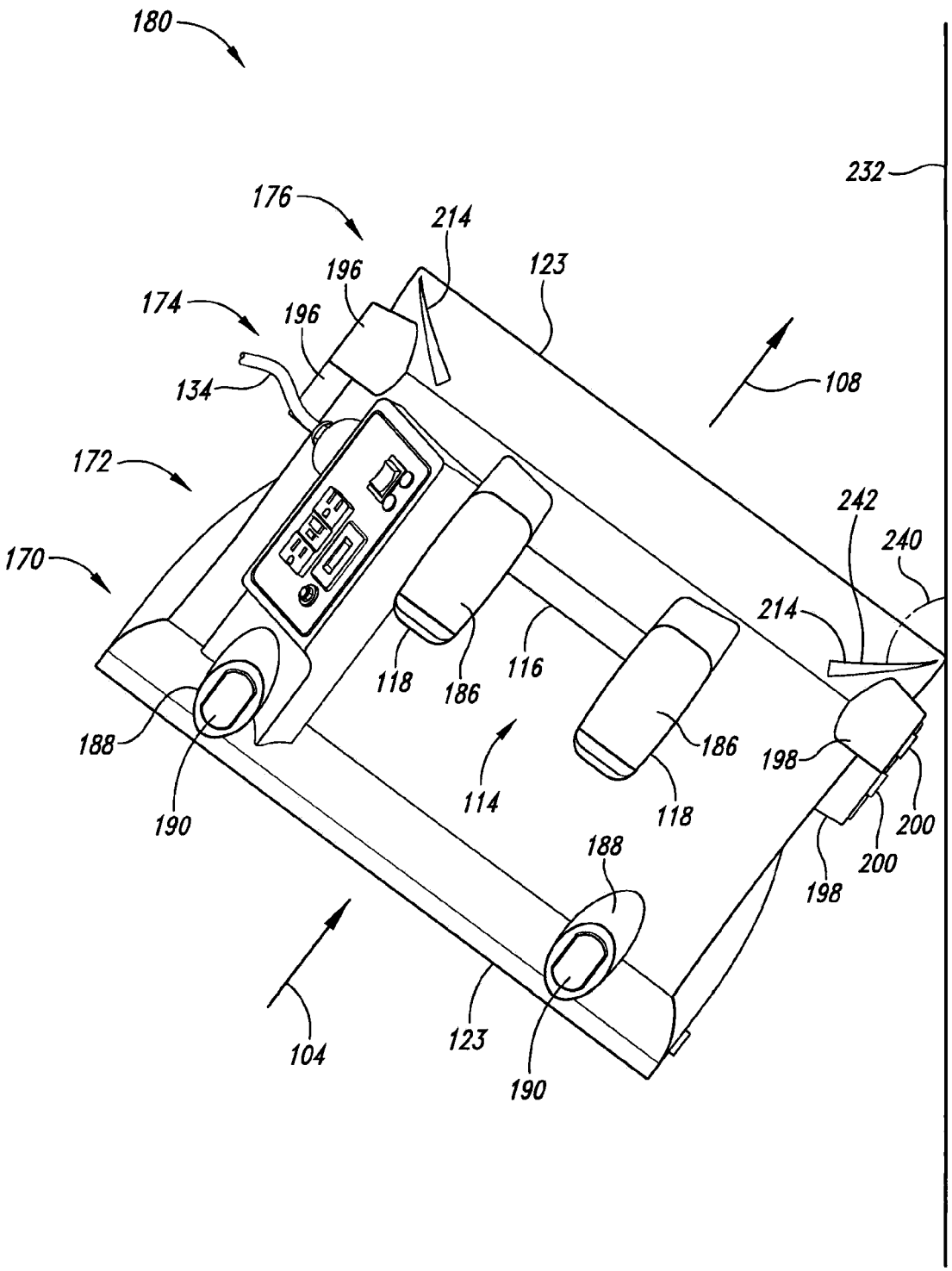
FIG. 23 is a top plan view of the augmented implementation of FIG. 7 showing alignment with a wall of the room of FIG. 21.

For various versions of the augmented implementation 180, there will generally be a particular acute angle 240 for aligning the augmented implementation relative to the wall 232. As shown in FIG. 23, the alignment guide 214 can be arranged to have a perpendicular instance 242 to be used to align the augmented implementation 180 relative to the wall 232. For the case in which the alignment guide 214 is used as the perpendicular instance 242, the augmented implementation 180 is aligned relative to the wall 232 such that the alignment guide 214 is approximately perpendicular to the wall. In other versions of the augmented implementation 180 other instances of the alignment guide 214 having other position angles relative to the wall 232 can be used.

Figure 24:
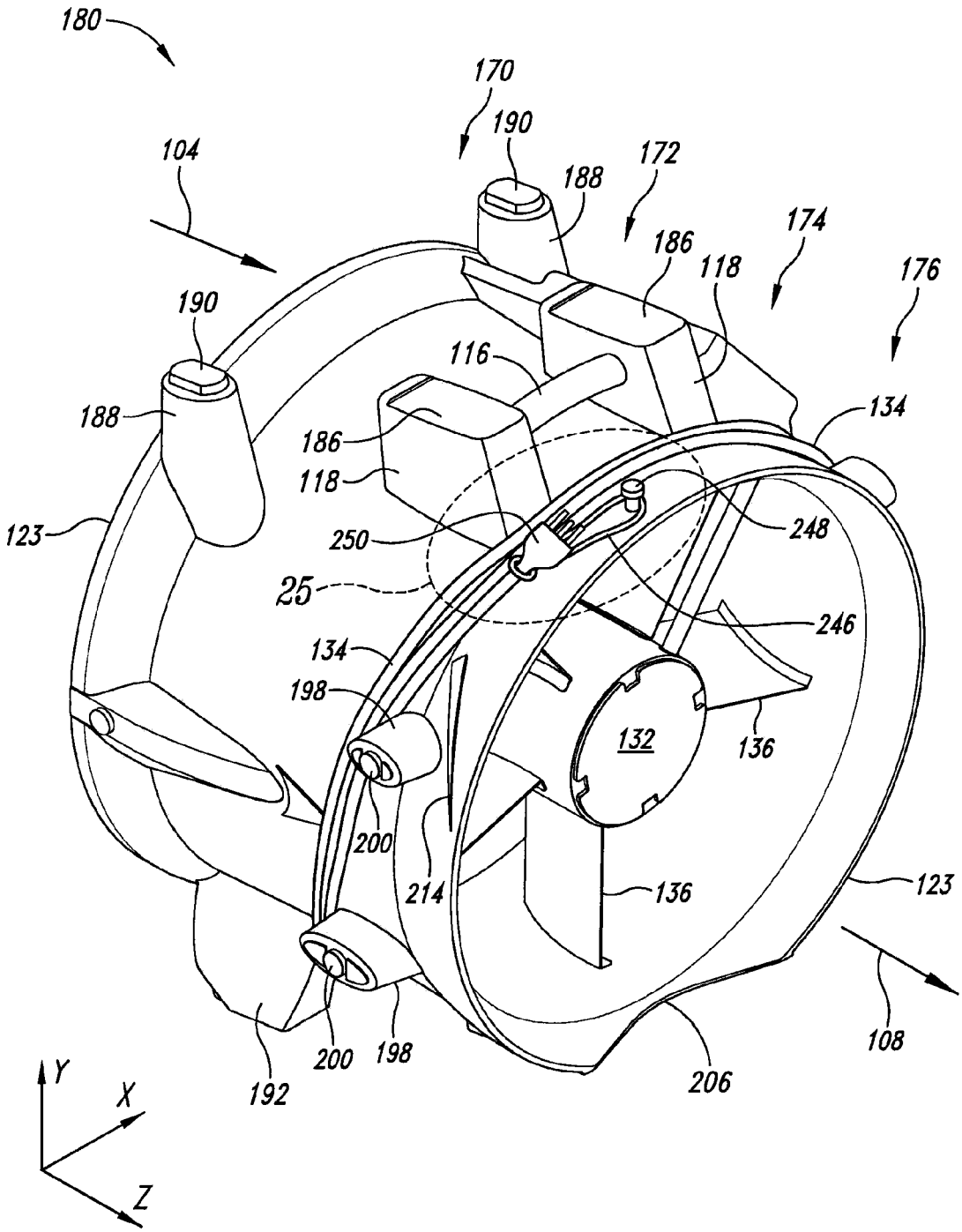
FIG. 24 is a top-outlet perspective starboard side view of the augmented implementation of FIG. 7 with a cord restraint system.
Figure 25:
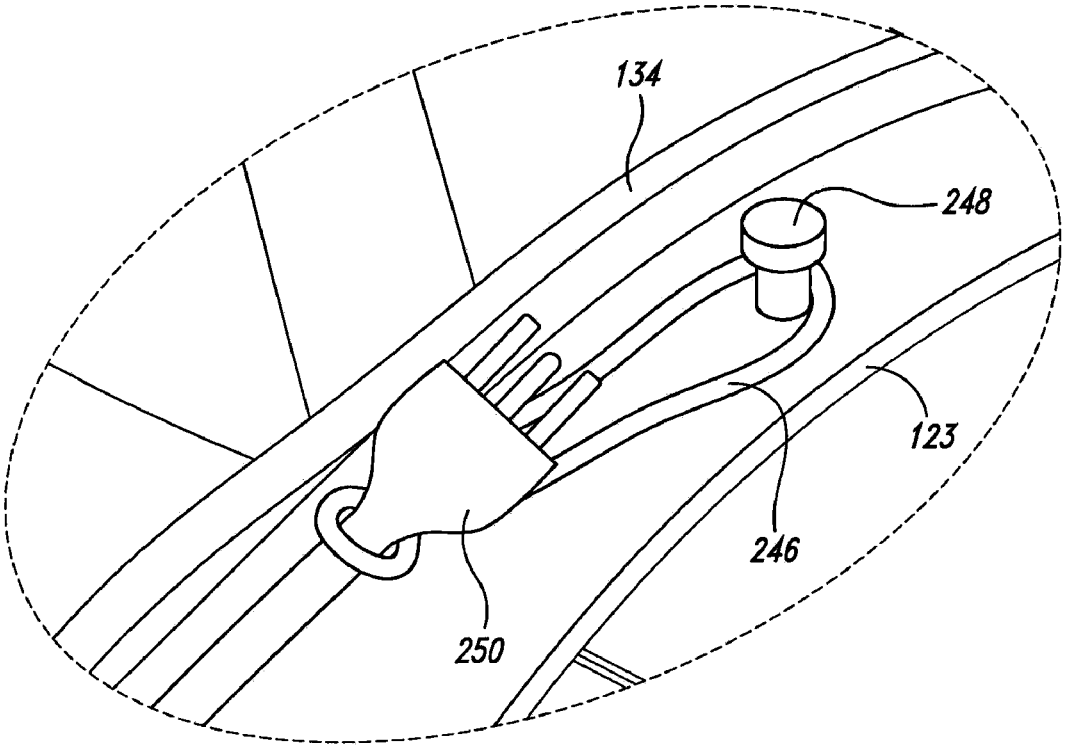
FIG. 25 is an enlarged fragmentary view of FIG. 24 showing engagement detail of the court restraint system.

The power cord 134 is shown in a secured position in FIG. 24 and FIG. 25 by using an elastic member 246, having a capability of resuming original shape after being stretched or expanded, to fasten the power cord to a protruding member such as a post 248 extending from the augmented implementation 180. As shown, the post 248 extends from the outlet portion 176 although in other versions of the augmented implementation 180, the post could extend from other locations of the augmented implementation.

Figure 26:
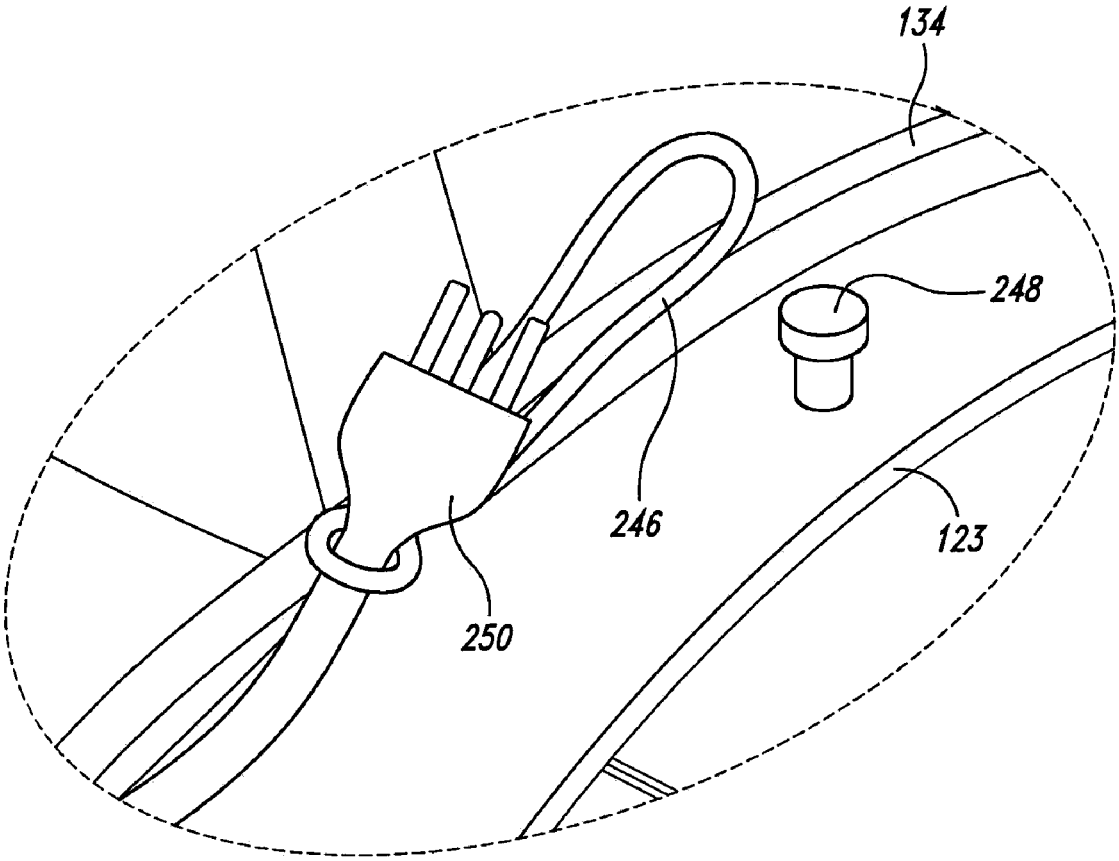
FIG. 26 is an enlarged fragmentary view of FIG. 24 showing disengagement detail of the cord restraint system.

The location of the post 248, expanded length and contracted length of the elastic member 246, length of the power cord 134, and location of the power cord passageway 135 are synergistically adjusted so that the elastic member 246 can be stretched to give sufficient tension to hold the power cord in place after the power cord has been wrapped around a portion of the augmented implementation 180 (such as being wrapped around the outlet portion 176 as depicted) when the elastic member is coupled with the post 248, or other protruding member. The elastic member 246 is also secured around a head portion 250 of the power cord 134 as depicted, however, in other versions, the elastic member can be coupled to the power cord in some other manner. To use the augmented implementation 180, the elastic member 246 is uncoupled from the post 248 as shown FIG. 26.

Figure 27:
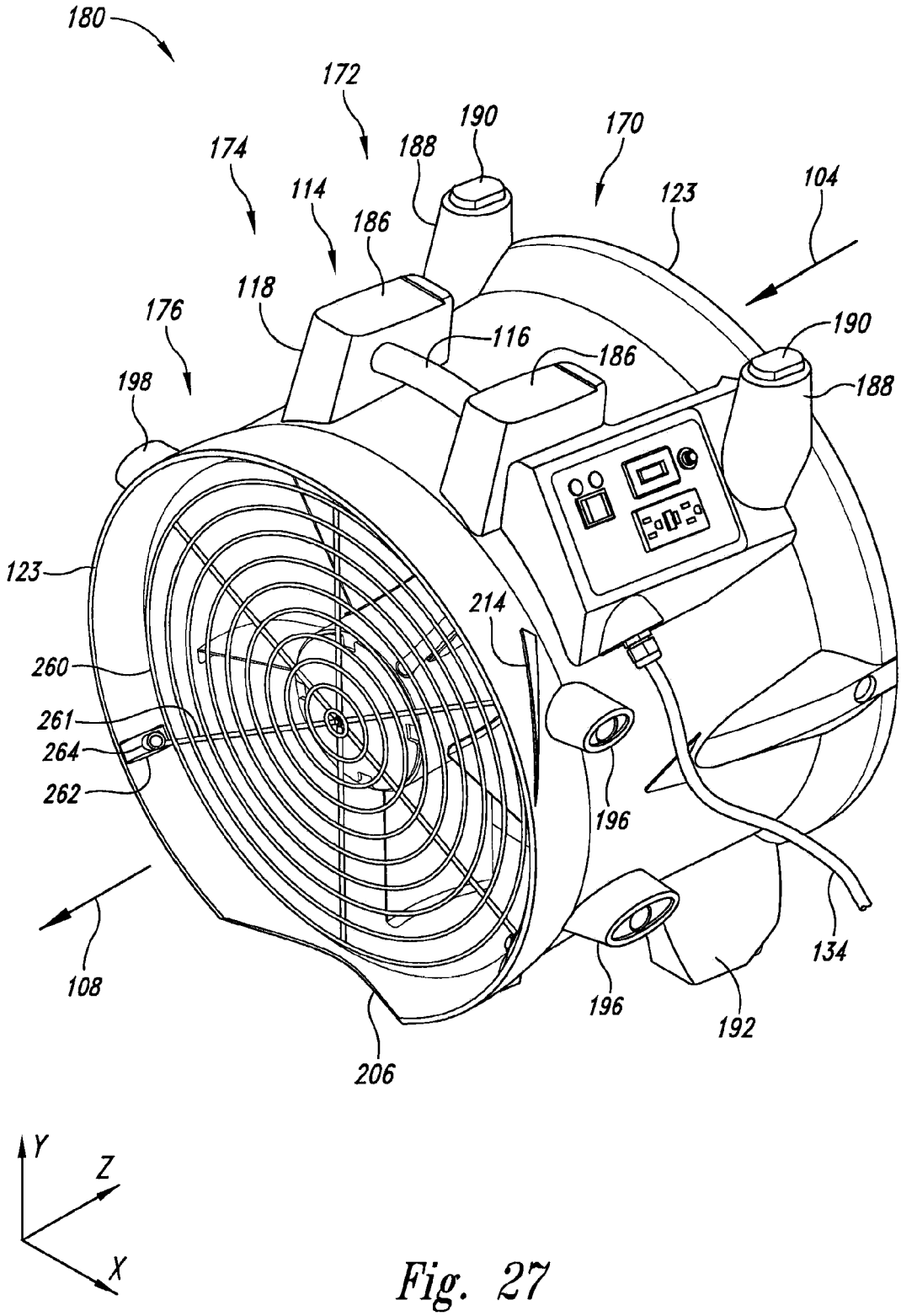
FIG. 27 is a top-outlet perspective port side view of the augmented implementation of FIG. 7 with an attached grill guard.
Figure 28:
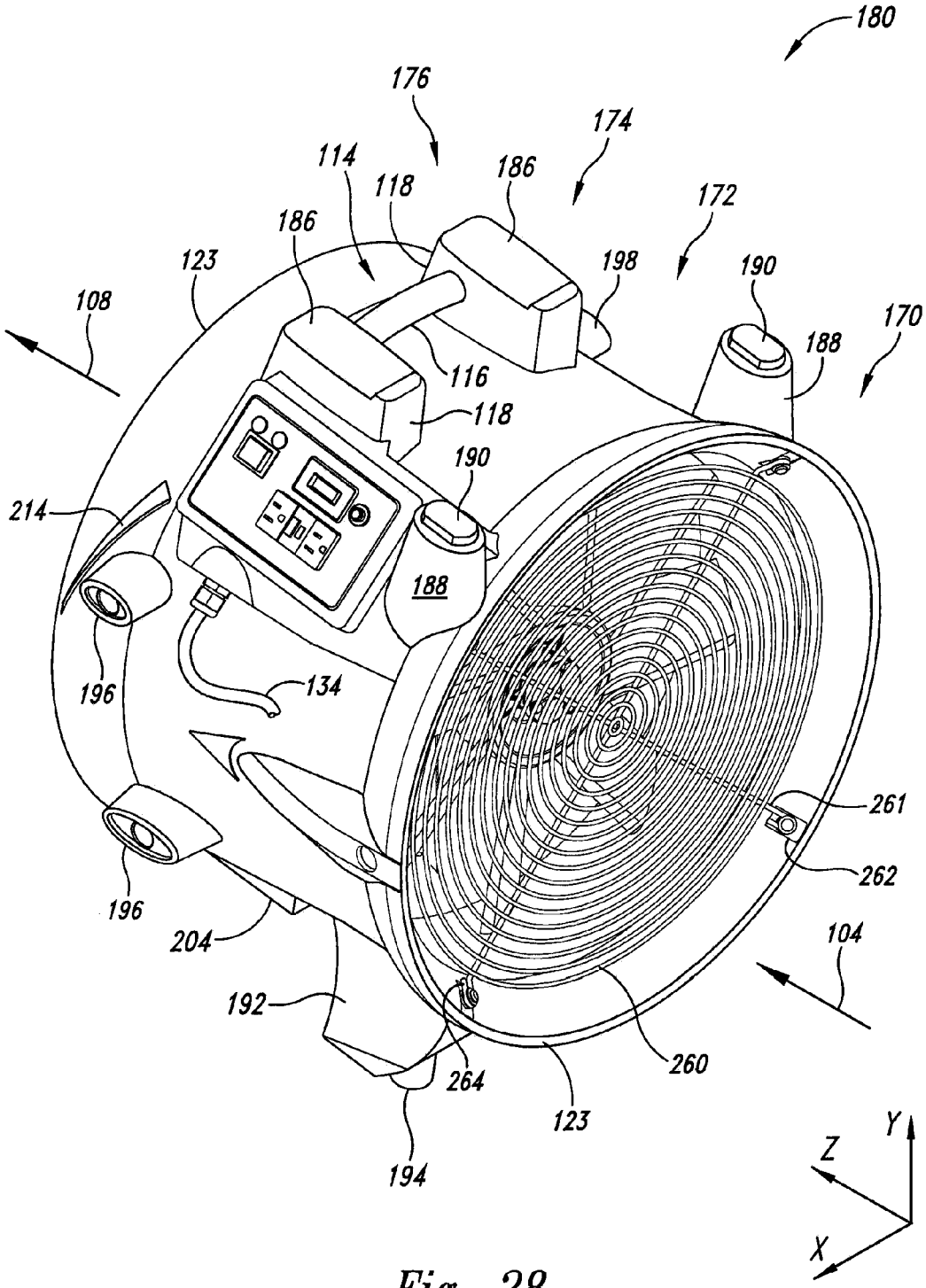
FIG. 28 is a top-inlet perspective port side view of the augmented implementation of FIG. 7 with an attached grill guard.
Figure 29:
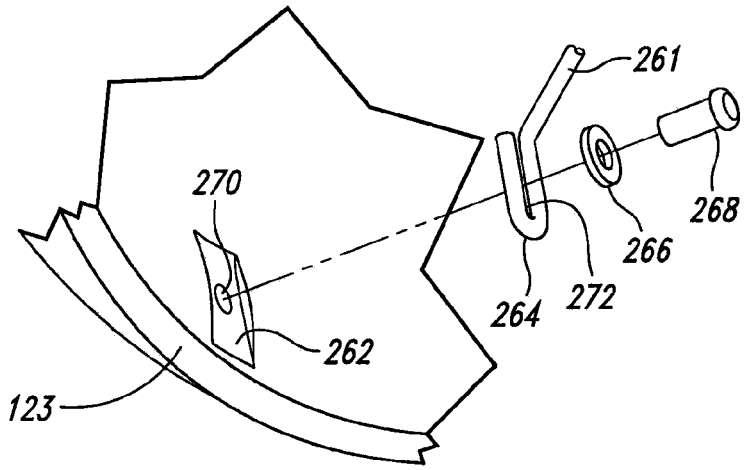
FIG. 29 is an enlarged exploded fragmentary view of one either of the grill guards of FIG. 27 and FIG. 28 showing engagement detail with the augmented implementation of FIG. 7.
Figure 30:
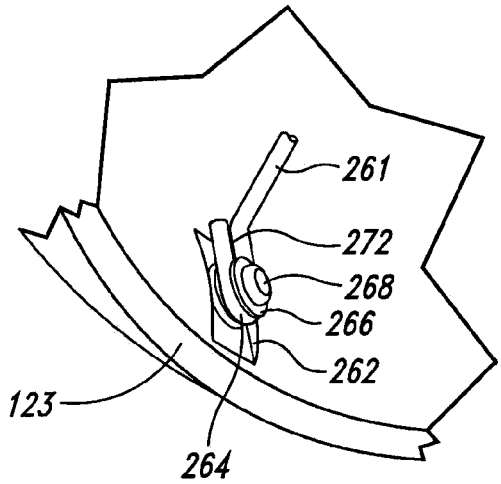
FIG. 30 is an enlarged fragmentary view of the grill guards of FIG. 29 with the grill being attached in a first position.
Figure 31:
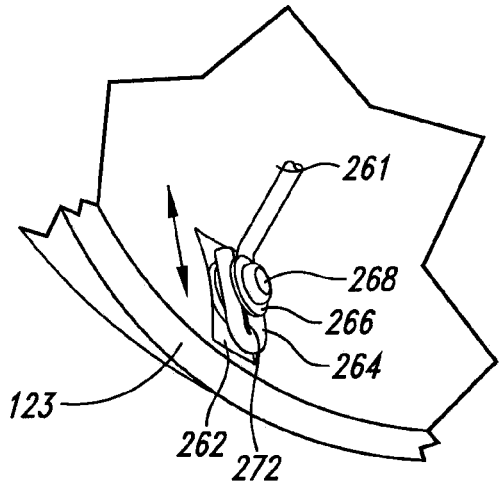
FIG. 31 is an enlarged fragmentary view of the grill guards of FIG. 29 with the grill being attached in a second position.

A grill guard 260 having support members 261 is shown in FIG. 27 with the support members coupled to the outlet portion 176 and is shown in FIG. 28 with support members coupled to the inlet portion 170 through brackets 262. As shown in FIGS. 29-31, the grill guard 260 has slotted end portions 264 that receive a washer 266 and screw 268 to couple with a threaded hole 270 in the bracket 262. The slotted end portion 264 has an elongated opening 272 that allows the slotted end portion 264 to be positionally adjusted relative to the screw 268 when the screw is coupled to the threaded hole 270 to account for dimension differences in the inlet portion 170 and the outlet portion 176 due to variation in manufacturing conditions. Consequently, use of the slotted end portions 264 on the grill guard 260 reduce assembly problems due to manufacturing variations.

Conventional air movers used in water damage restoration have been centrifugal type fans of dual inlet design. While there is a range of sizes and power configurations the vast majority fall in the ¼ to ½ horsepower (HP) range with ⅓ HP being typical. This type of fan would generate about 1250 cubic feet per minute (CFM) and have a static pressure capacity at zero flow at around 3 inches of water column. This type fan would draw about 5 amps at 115V. When multiple fans were used to do structural drying work finding enough available power became as issue. Contractors were using more and more fans on a job in an effort to speed the drying process. We looked at adapting axial fans that had been used for ventilation of confined spaces to this type of structural drying.

Items that had to be balanced in the design included the Diameter of the axial fan, the number of blades, the pitch of the blades, motor HP, RPM, blade tip clearance, barrel length and inlet and outlet design.

A vane axial fan with a 16" blade diameter in the correct housing could produce around 2000 CFM with a static pressure at zero flow of 1.3 inches of water column. This performance level required 1.4 HP which would draw 2.5 amps. This setup gave the contractor more airflow per unit running at half the amps. A given structural drying job would now dry quicker with less setup issues.

As we looked at how the fans were drying the structure we saw some opportunity for improvement. The air outlet of the fan is directed at the wall at an angle so that the air flows down the wall but also maintains a higher air pressure zone against the wall. If we ran the fan at no angle to the wall the air velocity down the wall increased but the amount of structural material, walls and floors, that was being dried decreased. We looked at angles from 5 to 55 degrees and found that angles between 25 and 35 degrees produced the largest drying area. We recommend a 30 degree angle against the wall.

We changed from a 8 blade 35 degree pitch to a 6 blade 30 pitch because we found that the inherent static load at the 30 degree angle to the wall would allow us to run the 6 blade configuration and increase flow and the overall drying area without adding more load, it still ran at 2.5 amps.

We also found that by shaping the air outlet to direct the flow down at floor level increased the amount of drying area. The original shell design was from a vane axial fan model line that we produced which used duct connection rings for the attachment of long runs of flexible ducting. This left a sharp edge at both the inlet and outlet that created some level of shock loss in the airflow. Because the structural drying application did not require any type of duct connection we changed the shape of the inlet and outlet in minimize the transition at the opening. This gave us much cleaner flow coming into the blade area and increased overall flow numbers. We were able to increase the size of the diameter of the blade to 17 inches without increasing the amp draw above the 2.5 amps in the smaller shell.

From the foregoing it will be appreciated that, although specific embodiments of the invention have been described herein for purposes of illustration, various modifications may be made without deviating from the spirit and scope of the invention. For instance in some implementations Further, in some instances, Likewise, Accordingly, the invention is not limited except as by the appended claims.

The invention claimed is:

1. An air mover system positionable on a floor, the air mover system comprising:

a fan assembly including a propeller and a motor, the propeller coupled to the motor, the fan assembly configured to move air in a direction of an airflow axis; and a housing assembly including an enclosure having an interior portion bounded by an inlet and an outlet, the inlet being raised relative to the outlet to pitch the outlet downward toward the floor, the fan assembly positioned within the interior portion, the enclosure further including an outlet perimeter edge portion comprising an arcuate raised portion and an arcuate lower edge portion, the arcuate raised portion having spaced apart first and second ends terminating adjacent to the floor and being raised above the floor between the spaced apart first and second ends, the arcuate raised portion disposed in a plane that is substantially perpendicular to the airflow axis, the arcuate lower edge portion disposed in a horizontal plane adjacent to the floor when the air mover system is positioned thereon.

* * * * *